US005943234A

United States Patent [19]

Martinez et al.

[11] Patent Number: 5,943,234

[45] Date of Patent: Aug. 24, 1999

[54] PAVING MIXTURE DESIGN SYSTEM

[75] Inventors: David Frederick Martinez; Elias El-Dahdah, both of Houston, Tex.

[73] Assignee: Atser Systems, Inc., Houston, Tex.

[21] Appl. No.: 08/766,714

[22] Filed: Dec. 13, 1996

[51] Int. Cl.[6] ..... G06F 19/00

[52] U.S. Cl. ..... 364/468.03; 364/468.24

[58] Field of Search ..... 364/468.03, 468.04, 364/468.24, 500, 502, 578, 528, 528.01; 106/281.1, 284.1, 276, 273.1; 208/22, 23, 34; 404/17; 427/138

[56] References Cited

U.S. PATENT DOCUMENTS

| | | | |
|---|---|---|---|
| 4,221,603 | 9/1980 | Trujillo | 106/281 |
| 4,357,169 | 11/1982 | Trujillo | 106/281 |
| 4,383,864 | 5/1983 | Trujillo | 106/281 |
| 5,284,509 | 2/1994 | Kamel et al. | 106/284.1 X |

OTHER PUBLICATIONS

HMA Materials and Mix Design Software Systems Course, ATSER Advanced Technology Science Engineering Research, Houston, Texas (1996).

SUPERPAVE™ Asphalt Mixture Design & Analysis, National Asphalt Training Center Demonstration Project 101, Federal Highway Administration, Apr. 1994.

Computer Program CAMA, Version 2.0, Computer–Assisted Ashhalt Mix Analysis User's Manual, Asphalt Institute, CP–6, Version 2.0, Mar. 1992.

Mix Design Methods For Asphalt Concrete and Other Hot–Mix Types, The Asphalt Institute, Manual Series No. 2 (MS–2), May 1984 Edition.

Introduction To Asphalt, The Asphalt Institute Manual Series No. 5 (MS–5), Eighth Edition.; Date Unknown.

Pine–Pave Level 1 Mix Design Software, Technical Specification, Pine Instrument Company, Grove City, PA, pp. 1–5.; Date Unknown.

Aschenbrener, Tim, et al., Factors that Affect the Voids in the Mineral Aggregate of Hot–Mix Asphalt, Colorado Department of Transporation, Transportation Research Record 1469; Date Unknown.

Hudson, S.B., et al., research entitled "Relationship of Aggregate Voidage to Gradation", pp. 574–593; Date Unknown.

Scheid, Francis, Ph.D., "Schaum's Outline of Theory and Problems of Numerical Analysis", Second Edition, pp. 420–422; Date Unknown.

Lipschutz, Seymour, Ph.D., et al., "Schaum's Outline of Theory and Problems of Finite Mathematics", Second Edition, pp. 127–131; Date Unknown.

*Primary Examiner*—Joseph Ruggiero
*Attorney, Agent, or Firm*—Fish & Richardson P.C.

[57] ABSTRACT

An apparatus and a method optimizes a job mix formulation (JMF) for hot mix asphaltic concrete. The apparatus receives JMF data input, including hand-entered data, hand-drawn data, or computer optimized data. The apparatus then generates a voids in the mineral aggregate (VMA) value. Next, it prompts the user to select a design methodology, including a Marshall mix methodology, a Hveem mix methodology, a Strategic Highway Research Program mix methodology, or a user definable mix methodology. Once the appropriate methodology has been selected, the apparatus applies a number of computations which use the VMA value. The apparatus also generates an aggregate composition for the hot mix asphaltic composition satisfying the job mix formulation based on the JMF data input and the selected design methodology.

40 Claims, 15 Drawing Sheets

PAVING MIXTURE DESIGN SYSTEM

FIELD OF THE INVENTION

This invention relates to an apparatus and a method for designing asphalt paving mixtures, and more particularly, to an apparatus and a method for determining and optimizing asphalt paving mixture properties.

BACKGROUND OF THE INVENTION

An effective transportation system plays a crucial role in the development and sustenance of a modern economy, as commerce depends on a reliable and a cost-effective method to deliver products to customers. In this context, pavements or other support surfaces for land vehicles or air vehicles during takeoff or landing phases are the backbone of the modern economy. Pavements are typically made up of a composite consisting of different sized aggregates generally excavated from earth deposits and which are designed to properly support various requirements. The primary purpose of a pavement is to transmit a load from the surface to the subgrade or underlying soil. Larger aggregates carry the load by coming into close proximity with one another, while sand or other fine aggregates fill the empty space between the larger aggregates. About 90% of all roadways and surfaces in the United States are made with asphalt, or more specifically, hot mix asphalt concrete (HMAC).

Asphalt is of particular interest to engineers because it is a strong, durable and highly waterproof cement. It is a plastic substance that imparts controllable flexibility to mixtures of mineral aggregates with which it is usually combined. It is, moreover, highly resistant to the action of acids, alkalies and salts. Although asphalt exists in a solid or semi-solid state at ordinary atmospheric temperature, it may be readily liquefied by applying heat or by dissolving it in petroleum solvents of varying volatility or by emulsifying it.

Asphalt is a natural constituent of petroleum products. The crude petroleum is refined to separate the various fractions and recover the asphalt. Similar processes occurring in nature have formed natural deposits of asphalt, some practically from extraneous matter, and some mixed with variable qualities of mineral matter. Further, asphalt can occur naturally within rocks. The rock is often referred to an asphalt impregnated rock. Hot mixed asphalt pavement consists of a combination of aggregates uniformly mixed and coated with asphalt cement. To dry the aggregates and obtain sufficient fluidity of the asphalt cement for proper mixing and workability, both must be heated prior to mixing, giving origin to the term "hot-mix".

The aggregates and asphalt are combined in an asphalt mixing plant in which they are heated, proportioned, and mixed to produce the desired paving mixture. After the plant mixing is complete, the hot-mix is transported to the paving site and spread with a paving machine in a loosely compacted layer to a uniform, smooth surface. While the paving mixture is still hot, it is further compacted by heavy self-propelled rollers to produce a smooth, well-consolidated course. The aggregates normally used are well graded, clean, cohesionless, and have high angles of internal fraction. Asphalt cement, a product of the refining of crude oil, is a reversible thermoplastic; its strength changes with temperature, as is known in the art. The viscosity of a typical paving grade of asphalt cement will be in the order of 2,500 poises at 140° F. and 6,000,000 poises at 77° F., and even higher at lower temperatures. This is a rather significant change when compared to the temperature change in strength of other construction materials.

Asphalt strength varies with the rate of loading. Recent research has attempted to associate the viscoelastic properties to pavement performance. The balance between durability and resistance to permanent deformation remains a constant design concern. Maximum durability is desired. However, resistance to permanent deformations cannot be overlooked. The reduced strength of asphalt cement at slow rates of loading is a desirable characteristic since it prevents the formation of regularly spaced transverse cracks in asphalt pavements. However, at this reduced strength condition, the pavement must resist excessive plastic behavior. Tensile stresses develop in all pavements as they contract during cooling. If the pavement is made with cement that has insufficient tensile strength, the tensile stress will exceed the tensile strength and cracks will occur. In pavements made with Portland cement, the tensile stresses will exceed the tensile strength when the dimension of the pavement exceeds about 15 feet. Grooves or spacers are placed at these intervals to form contraction joints that are straight and can be maintained more easily than meandering cracks.

If the strength of the asphalt cement is low enough at the rate of loading produced by contraction, the asphalt cement yields as load is applied by contraction. No significant tensile stresses build up and no transverse cracks occur. In most of the United States the climatic conditions are such that the rate of loading is slow enough that the asphalt cements normally used yield enough during contraction that transverse cracks do not develop. In the northern tier of states the climatic conditions are such that in cold weather, cooling shrinks the pavement faster than the asphalt cement can yield and thermal cracks occur.

The low strength of asphalt cement at slow rates of loading is the reason reflection cracks occur in asphalt overlays over concrete pavements. Contraction of the underlying concrete concentrates strain in the asphalt overlay directly above the joints in the concrete pavement producing tensile stress in the asphalt pavement. Since this tensile stress is applied at a slow rate of loading, the strength of the asphalt cement is very low and cracks occur in the asphalt overlay over the joints.

The design of asphalt paving mixes, as with other engineering materials designs, is largely a matter of selecting and proportioning materials to obtain the desired properties in the finished construction. The overall objective for the design of asphalt paving mixes is to determine an economical blend of binder and gradation of aggregates, within the limits of the project specifications, and an asphalt paving mixture that yields a mix having:

1. sufficient asphalt to ensure a durable pavement;
2. sufficient mix stability to satisfy the demands of traffic without distortion or displacement;
3. sufficient voids in the total compacted mix to allow for a slight amount of additional compaction under traffic loading without flushing, bleeding, and loss of stability, yet low enough to minimize the intrusion of harmful air and moisture.
4. sufficient workability to permit efficient placement of the mix without segregation.

Due to the importance of the proper mixture of coarse aggregates, fine aggregates and asphalt cement which in turn controls the segregation and degradation of aggregates which occurs during crushing, storage, mixing, tumbling, transportation and laydown operations, builders typically specify that the pavement contractors deploy a particular Job-Mix Formula (JMF). The job mix formula defines the actual gradation and asphalt content to be obtained in the finished construction. JMF is usually designated by the builder or contractor authority as a series of percentages associated with the number of sieves which describes the aggregate blend. As explained in U.S. Pat. No. 4,383,864, entitled "Adaptive Mix Proportioning Method For Use In Asphaltic Concrete Mixing Plants" to Trujillo, a typical Job-Mix Formula may be designated as 100% passing in a ¾" sieve, 80–100% passing in a ½" sieve, 70–90% passing in a ⅜" sieve, 55–73% passing in a number 4 screen, 40–55% passing in a number 8 screen, 20–30% passing a number 30 screen, 10–18% passing a number 100 screen, and 4–10% passing a number 200 screen. Any blend of aggregates within the range designated by the Job-Mix Formula specification is generally acceptable to the builder or contracting authority, provided the proposed JMF satisfies other design criteria. The JMF thus is the combination of individual aggregates with a designed binder content that results in pavement performance. A proper aggregate gradation should have a balance of material sizes sufficient to promote particle contact and provide a controlled voids content in the compacted mixture.

In computing the JMF values, sieve sizes to be used are designated in governing specifications. Determining the percentages from weights obtained by sieve analysis. Gradations are usually expressed on the basis of total percent passing, which indicates the total percent of aggregate by weight that will pass a given size sieve. The total percent retained is just the opposite; the total percent by weight retained on a given sieve. The percent passing-retained, two successive sieve sizes or individual percent for each size group, indicates the percent retained by weight on each sieve in the sieve analysis. Certain descriptive terms used in referring to aggregate gradations are:

a) Coarse aggregate, all the materials retained on the No. 8 sieve.

b) Fine aggregate, all the materials passing the No. 8 sieve c) Mineral dust, that portion of the fine aggregate passing the No. 200 sieve d) Mineral filler, a finely divided mineral product, at least 70 percent of which will pass a No. 200 sieve.

Conformance with the Job-Fix Formula is generally performed at a mixing plant where the asphalt cement injected into the mixing bin can be accurately controlled as a percentage by weight of the total mix. As indicated earlier, an effective amount of asphalt cement governs the amount of air voids in a compacted mixture and varies as a function of the shape, absorption characteristics, and sizes. However, as noted in Trujillo, gradation is hard to control in accordance with the Job-Mix formula at the mixing plant and at the laydown site due to degradation and segregation of the aggregates and due to the lack of adequate feeding controls for separate storage bins in the mixing plant.

U.S. Pat. No. 4,221,603, entitled "Mix Design Method For Asphalt Paving Mixtures," issued to Trujillo, shows a Mix-Design Method for determining degradation of coarse and fine aggregates to be combined to achieve a predetermined percentage of air void, volume and voids in mineral aggregates for a given quantity of asphalt cement. The method uses a volumetric value known as the Riguez Index which is derived from a compacted representative sample of fine aggregates to be used in a mixing plant. Volumes of graded aggregate composites are calculated at various gradations values below the bulking point and compared with the Riguez Index to provide the basis for graphically selecting a particular gradation wherein an aggregate mixture of the particular gradation contains the desired predetermined void volumes as when compacted. Related U.S. Pat. No. 4,357,169, entitled "Uniform Asphalt Pavement And Production Method Therefore" issued to Trujillo, shows that to control voidage of the mixing plant, respective quantities of coarse and fine aggregates injected into the mixing plant is controlled over the same single sieve side used for demarcating coarse and fine aggregates and mathematically computing the volumetric comparison. Furthermore, a stability function derived from a different combination of the crushed, fine and blend sand, and a flexibility function derived from different mix quantities of asphalt cement provide control of flexibility and stability values. This design methodology to arrive at an optimum asphaltic mixture is still a trial and error procedure. Good mixes generally result from a knowledge of aggregates, experience and luck.

During the contracting phase, contractors need an accurate forecast of costs. In addition to the expense of labor, one significant expenditure is the cost of the HMAC. However, an accurate cost projection for the HMAC is difficult, for any given aggregate blend, the effective asphalt content may vary. Coarser aggregates may require less asphalt than finer aggregates. However, coarser aggregate blends may cost more than finer aggregate blends. Thus, any cost estimate of the hot mix asphalt concrete requires an accounting of the cost of two major components, asphalt and aggregates, as well as the effect of their interactions. The variability of aggregate sizes and absorption further exacerbates the JMF analysis.

Traditionally, the process of designing Hot Mix Asphaltic Concrete mixtures is divided into three steps: the selection of an aggregate type, quality and blend, the selection of a type of asphalt binder type, and the determination of an optimum JMF (i.e., aggregates and asphalt content). Three different basic methods have been used in the design of the HMAC: a Marshall method, a Hveem method, and a Strategic Highway Research Program (SHRP) method. In the early 1900's, Mr. Francis Hveem with the California Department of Highways developed the Hveem Method of Mix Design. This process was labor intensive, requiring extensive laboratory testing and engineering analysis. The objective was to determine the optimum proportion of asphalt cement and aggregates. From the 1930's to the 1980's the Marshall Method of mix designs and its hybrids became the most preferred method of mix design. This method was successful in selecting an estimated optimum asphalt cement content. However, the resulting mix design job mix formula did not necessarily perform well in the field for all climatic and traffic loading conditions. The Marshall procedure was satisfactory in estimating optimum asphalt content, but did not correlate well with actual field performance. The most recent design method is the SHRP method. All these methods are iterative testing laboratory procedures that require extensive laboratory time and raw materials. The SHRP method of mix design further aggravates the cost and time of mix design since it requires a trial and error laboratory procedure to determine the aggregate design structure. Thus trial and error procedure has been known to take weeks to determine an acceptable aggregate skeleton.

In generating the cost estimates, the construction industry traditionally uses intuition, along with a calculator or a manual or electronic spreadsheet, to arrive at an optimum and cost effective job mix formula. Typically, the acquisition of adequate experience based on the trial and error process is quite costly and time-consuming in today's competitive environment. While spreadsheets and calculators are helpful in speeding up the estimates, they are neither easy to use nor very flexible. Present day systems typically require the user to enter various percentages, plot the results of these data inputs, and iteratively change the data until a satisfactory solution is reached. Furthermore, to the extent that these solutions provide computer-aided-optimization, the optimizing software tends to be slow and cumbersome to use. Some of these optimizations require 15 hours before a solution can be found. Furthermore, the potential least cost JMF compliance with agency mixture criteria is not known until an extensive laboratory analysis is undertaken. Often, the designer learns a potential JMF has not been successful once he or she completed an extensive laboratory study. Thus, a more efficient and easier to use system to determine the most cost effective JMF (i.e., blend of known aggregates and asphalt) and its likelihood to satisfy a mixture design criteria is needed.

Furthermore, the construction industry still uses a series of laboratory tests to determine the value of the bulk specific gravity of the laboratory molded sample $G_{mb}$, which is an important parameter in the mix design. $G_{mb}$ is critical in determining the voids in the mixture, other volumetric properties and an optimum binder content. However, as the series of laboratory tests is iterative and repetitive, the process of running these tests is costly both in time and in materials. Also, once a designer learns that a current blend does not satisfy the criteria, he or she has to begin the process once again. Thus, a more efficient way to estimate $G_{mb}$ is needed. Similarly, a system for determining all the volumetric properties, including total voids in the mixture, voids in mineral aggregates (VMA), the percent of voids filled with asphalts (VFA) is also needed. The prediction of volumetric properties also permits the estimation of an optimum binder content.

Turning now to the data entry process for arriving at the job mix formula, one historical method for entering data in satisfaction of the job mix formula specification is by manual entry of data and subsequent plotting of the entered data. Based on the graphical plots, experienced engineers can blend the components by reviewing the aggregate shape. However, this data entry method is cumbersome. What is needed is a graphical method for entering the desired shape of the gradation blends and generating a list of optimized blended components automatically.

SUMMARY OF THE INVENTION

The present invention provides an apparatus and a method for estimating final mixture design properties while minimizing the requirement for time consuming and costly laboratory studies. The apparatus optimizes a proposed job mix formulation (JMF) for hot mix asphaltic concrete while ensuring that the proposed solution satisfies all mixture design criteria.

The apparatus receives JMF data input, including hand-entered data, hand-drawn data, or computer optimized data. Additionally, as the latest design method such as the Strategic Highway Research Program (SHRP) method requires the use of an "S" shape gradation curve, the present invention provides a graphical method for entering the desired shape of the gradation blends and generating a list of optimized blended components automatically. The automatic generation of the proposed gradation curve corresponding to the shape of the drawn curve provides a more efficient, rapid, flexible and powerful method of entering data on the JMF curve.

The selected JMF mixture properties can be estimated using an enhanced mixed design method with predicted voids in the mineral aggregates, bulk specific gravity of the molded laboratory specimen, and specimen height during the compaction process. The predicted values can be verified for compliance with established design criteria; thereby avoiding costly, labor intensive mixture design studies.

Once the gradation information has been entered, the apparatus then generates a voids in the mineral aggregate (VMA) value. Next, it prompts the user to select a design methodology, including a Marshall mix methodology, a Hveem mix methodology, a Strategic Highway Research Program mix methodology, or a user definable mix methodology. Once the appropriate solution or methodology has been selected, the apparatus applies a number of computations which use the VMA value. The apparatus also generates an aggregate composition for the hot mix asphaltic composition satisfying the job mix formulation based on the JMF data input and the selected design methodology.

Thus, from the gradation chart input, the present invention estimates all design criteria, including volumetric properties such as voids in mineral aggregates, VMA, and a bulk specific gravity of the mix, $G_{mb}$, among other volumetric properties and mechanical properties, which are used in the design methodologies to arrive at blends of various aggregates of mixes matching the customer's needs. Hence, the apparatus and method of the present invention avoids the inefficiency of the laboratory trial-and-error process by providing a quicker and easier to use system to determine the most cost effective blend of known aggregates into a satisfactory JMF specification. Thus, the apparatus allows the user to rapidly determine whether a proposed JMF having a combination of aggregates and asphalts that defines the actual gradation and asphalt content to be obtained in the finished construction complies with design criteria.

BRIEF DESCRIPTION OF THE DRAWINGS

A better understanding of the present invention can be obtained when the following detailed description of the preferred embodiment is considered in conjunction with the following drawings, in which.

DETAILED DESCRIPTION OF THE PREFERRED EMBODIMENT

A. Glossary of Terms

Figure 1A:
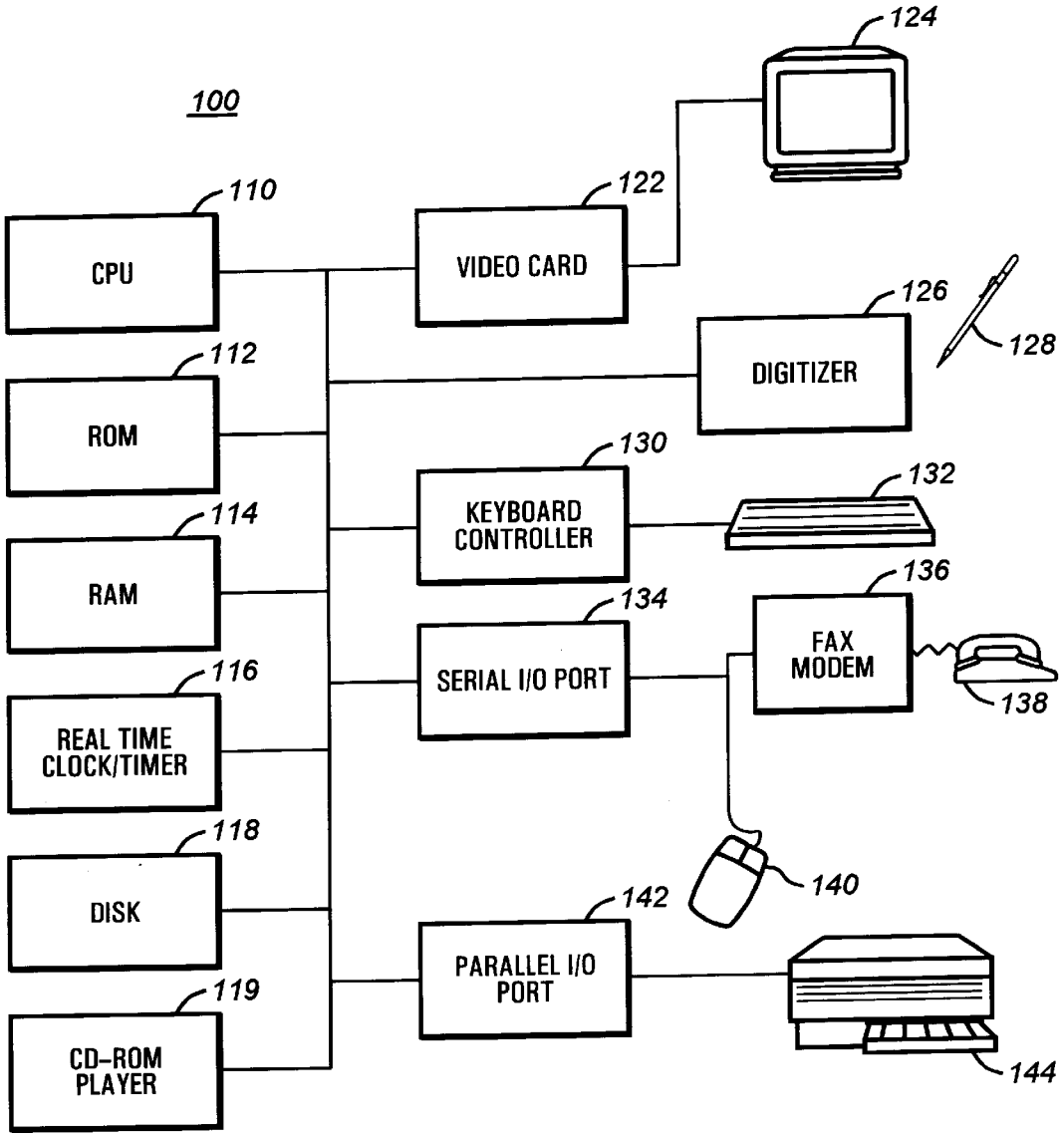
FIG. 1A is a schematic diagram of a computer system for executing the mix design process of the present invention.

For ease of reference, terms as defined for use in describing the present invention are set forth below. As will be evident to those skilled in the art, the definitions incorporate both current standard meanings as well as extended meanings as prove necessary. They include the following:

Aggregate: Any hard, inert, mineral material used for mixing in graduated fragments. It includes sand, gravel, crushed stone, slag, shell, used with a cementing medium to form mortar, or concrete, or alone as in base courses, railroad ballasts, among others. Aggregates can include industrial waste products such as ashes, polymers, plastics, synthetic materials, chemical additives and mineral fillers.

Aggregate Bulk Specific Gravity: ($G_{sb}$) A ratio of the mass in air of a unit volume of aggregate, including permeable and impermeable voids, to the mass of an equal volume of water, both at the same temperature.

Aggregate, Coarse: Materials retained on the 2.36 mm (No. 8 or No. 10) sieve.

Aggregate Effective Specific Gravity: ($G_{se}$) A ratio of the mass in air of a unit volume of aggregate, excluding voids permeable to asphalt, to the mass of an equal volume of water, both at the same temperature.

Aggregate, Fine-Graded: An aggregate having a continuous grading in sizes of particles from coarse through fine with a predominance of fine sizes.

Aggregate, Macadam: A coarse aggregate to uniform size usually of crushed stone, slag or gravel.

Aggregate, Open-Graded: An aggregate containing little or no mineral filler or in which the void spaces in the compacted aggregate are relatively large.

Aggregate, Well-Graded: An aggregate that is graded from the maximum size down to filler with the object of obtaining an asphalt mix with a controlled void content and high stability.

Air voids: ($V_a$): A total volume of the small air pockets between coated aggregate particles; expressed as a percentage of the bulk volume of the compacted paving mixture.

Asphalt: A dark brown to black cementitious material in which the predominating constituents are bitumens which occur in nature or are obtained in petroleum processing (ASTM* Designation D8). Asphalt is a constituent in varying proportions of most crude petroleums. The asphalt includes modified binders such as polymers, elastomers, plastics, mineral fillers, rubbers, antioxidants, oxidants, and anti-stripping agents.

Asphalt Binder Specific Gravity: ($G_b$) A ratio of the mass in air of a given volume of asphalt binder to the mass of an equal volume of water, both at the same temperature.

Criteria: (Plural of Criterion): A standard rule or text on which a decision or judgment can be based. Agencies often establish criteria for mixture properties believed to relate to performance.

Effective Asphalt Content: ($P_{be}$) A measurement of a total asphalt content of the paving mixture less the portion of asphalt binder that is absorbed by the aggregate particles; expressed as a percentage of the total weight of the compacted paving mixture.

Job Mix Formula (JMF): A combination of construction materials designed to satisfy an agency specification. The materials can include aggregate, synthetic aggregate, waste by-products, asphalt, mineral filler, (including admixtures or chemical additive, or other products). The entire JMF recipe is designed to satisfy the specification requirements. Most often, the JMF result is the final product of a laboratory mix design.

Job Mix Formulation: A blend of aggregates and asphalt or binder which satisfies the specification. A suitable formulation should demonstrate the following characteristics:

Workability—the case at which a mix is place, tight mix, less voids, less moisture infiltration minimize stripping, minimize oxidation-cracking smooth curves are easier to compact improved stability. Resistance to Segregation: A measure of the tendency for large aggregates to roll away from fine aggregates, resulting in a loss of point contact.

Internal Friction—A load carrying characteristic of the pavement. The internal friction develops through particle contact, missing sizes diminish internal friction.

Tender Mixes—Gradations which are difficult to compact at normal composition, temperature and usually associated with a hump near the 40 sieve.

Durability—A measure of space available for moisture infiltration ability to produce a dense gradation such that moisture and our infiltration is minimized.

Stability—A high stability aggregate gradation should have a balance of materials sizes sufficient to promote particle contact.

Least Cost: The smallest minimum amount, in magnitude, required in payment for the purchase of the materials that compose the Job Mix Formula.

Master Gradation Limit: Upper or lower limits for combined gradation compose materials to satisfy master limits as specified by the regulatory agency.

Methodology: A system of principles, practices, and procedures applied to any specific brand of knowledge. Hot Mix Asphalt Concrete (HMAC) has known principles.

Mixture Bulk Specific Gravity: ($G_{mb}$) A ratio of the mass in air of a given volume of compacted HMA to the mass of an equal volume of water, both at the same temperature. The $G_{mb}$ is determined for laboratory testing and field compacted samples.

Property: A quality serving to describe an object or substance. Hot Mix Asphalt Concrete (HMAC) properties include void proportion, densities, specific gravities, asphalt content, water absorption, Marshall stability and flow, Hveem stability, mechanical properties, flexibility, fatigue resistance, skid resistance, compactability, and workability.

Theoretical Maximum Specific Gravity of the Mix ($G_{mm}$): A ratio of the mass of a given volume of HMA with no air voids to the mass of an equal volume of water, both at the same temperature. This value is determined by laboratory tests or by individual aggregate gravities computations.

Voids Filled with Asphalt ($P_{fa}$ or VFA): A portion of the VMA that contains asphalt binder; expressed as a percentage of the total volume of mix or VMA.

Voids in the Mineral Aggregate (VMA): A volume of intergranular void space between the aggregate particles of a compacted paving mixture that includes the air voids and effective asphalt content; expressed as a percentage of the total volume of the compacted paving mixture.

Volume of Absorbed Asphalts ($V_{ba}$): A volume of asphalt binder that has been absorbed into the pores of the aggregate.

Logarithmic Grading Chart: The logarithmic grading chart is used for 1) illustrating aggregate gradations; 2) and relating the grading characteristics to asphaltic mix performances. Some based relationships were developed by Hveem (K) in 1940 and have withstood technological scrutiny for four decades.

Maximum Density Charts: A type of chart developed by Goode and Liefsey which has been widely adopted, as a companion to the logarithmic grading chart, by the Federal Highway Administration, the Asphalt Institute and others.

Maximum Density Gradation Plot: A maximum density curve is used to adjust aggregate blends, in accordance with $$P=100(d/D)^n$$

where

P=total percentages passing given sieve d=size of sieve opening, n=0.5 for a Fuller method, 0.45 for FHWA and Asphalt Institute Methods, and D=largest size (sieve opening) in gradation.

B. The Paving Mixture Design System

Turning now to the drawings, FIG. 1A shows a block diagram of a computer 100 supporting the paving mixture design system of the present invention. In FIG. 1, a central processing unit (CPU) 110 provides processing power for the computer system 100. The CPU 110 is preferably an Intel Pentium-Pro® processor. However, a number of other microprocessors may be used, including a PowerPC microprocessor, an R4000 microprocessor, a Sparc microprocessor, or an Alpha microprocessor, among others. The CPU 110 is connected to a read only memory (ROM) 112. The ROM 112 provides boot code such as a system BIOS software that boots up the CPU 110 and executes a power up self test (POST) on the computer system 100.

In addition, the CPU 110 is connected to a random access memory (RAM) 114. The RAM 114 allows the CPU 110 to buffer instructions as well as data in its buffer while the computer 100 is in operation. The RAM 114 is preferably a dynamic RAM array with 32 megabytes of memory. The CPU 110 is also connected to a real time clock and timer 116. The real time clock and timer 116 stores the dates and time information for the CPU 110. Furthermore, the real time clock and timer 116 has a lithium backup battery to maintain the time information even when the computer system 100 is turned off.

The CPU 110 is also connected to a disk storage device 118. The disk storage device 118 stores executable code as well as data to be provided to the CPU 110. Additionally, the CPU 110 is connected to a CD-ROM drive. Typically, an IBM PC compatible computer controls the disk drive 118 and the CD-ROM player 119 via an Intelligent Drive Electronics (IDE) interface.

The CPU 110 is also connected to a video card 122. On the back of the video card 122 are one or more jacks. Connectors for monitors can be plugged into the jacks. The connectors, which are adapted to be plugged into the jacks of the video card 122, eventually are connected to the input of a monitor 124 for display. A pen-based user interface is also provided. A digitizer 126 is connected to the CPU 110 and is adapted to capture user input. Additionally, a pen 128 is provided to allow the user to operate the computer. The pen 128 and digitizer 126 in combination supports another mode of data entry in addition to a keyboard 132.

While the video monitor 124 receives the output signals from the CPU 110 to the user, the keyboard 132 is connected to a keyboard controller 130 for providing input information to the CPU 110. Additionally, one or more serial input/output (I/O) ports 134 are provided in the computer system 100. Connected to the serial I/O ports 134 are a plurality of peripherals, including a mouse 140 and a facsimile modem 136. The facsimile modem 136 in turn is connected to a telephone unit 138 for connection to an Internet service provider 90, for example. Preferably, the modem 136 is a 28.8 kilobits per second modem (or greater) that converts information from the computer into analog signals transmitted by ordinary phone lines or plain old telephone service (POTS). Alternatively, the modem 136 could connect via an integrated service digital network (ISDN) line to transfer data at higher speeds. Furthermore, a parallel input/output (I/O) port 142 is provided to link to other peripherals. Connected to the parallel I/O port 142 is a laser printer 144.

The output generated by the computer system 100 is used to control the mixing process at the mixing plant, which is preferably located near the site of the pavement to minimize transportation costs. During mixing, the aggregates are proportioned according to a predesigned job fix formula and a predetermined quantity of asphalt cement. The entire combination of aggregates and asphalt cement is then heated to a predetermined mixing temperature. After the mixing and the heating process, the mixture is dumped from the bottom of a mixing bin into a dump truck that transports the hot mix to the pavement site. Laydown equipment picks up the hot mix and spreads the hot mix onto a prepared pavement subgrade or on top of existing asphalt or concrete surface in case of an overlay. The mixture is then dumped in place, spread by a paving machine, and finally compacted in place by heavy steam rollers which compact the hot mix to produce the pavement.

Typically, a conventional asphalt paving mixture plant includes a number of feeding bins for storing mineral aggregates of different sizes. Aggregates within these storage bins are obtained from various stockpiles. For example, the mixing plant can include a number of different storage bins for separately storing mineral filler, blend sand, crushed fines, intermediate coarse aggregate, and coarse aggregate, among others. The different sized aggregates in the storage bins are dumped through either regulated or unregulated gate valves respectively onto a series of intermediate variable speed feed valves. The rate of aggregate feed is conventionally controlled by controlling the speed of feed belts. The different sized aggregate from each of the intermediate feed belts are then supplied to the main feed belt which carries all aggregates into an elevator belt which loads the aggregates into a mixing bin. The mixing bin is supported by a frame above a loading station which receives a transporting vehicle for transporting the hot mix to the pavement site. The process for determining the optimal mix to be performed by the mixing plant is described next.

Figure 1B:
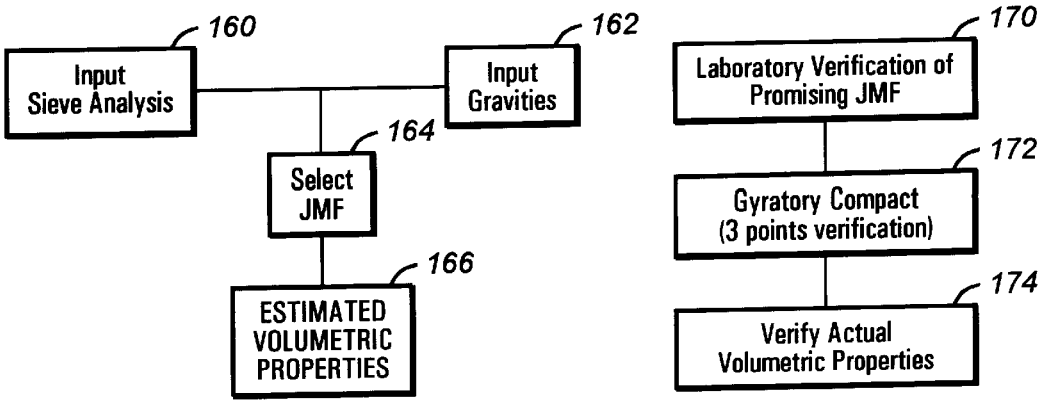
FIG. 1B is a flow chart of the mixture design system in accordance with the present invention.

Referring now to FIG. 1B, the process for estimating mixture design is illustrated in more detail. The inputs to the process of FIG. 1B includes a sieve analysis input 160 and a gravities input 162. The inputs received from steps 160 and 162 are provided to a JMF selection step 164. In this step, a variety of tools, including a graphical data entry tool, a computer optimized data entry tool, a forced data entry tool, and the manual data entry tool, are provided to select the JMF in step 164. The output of the JMF selection step 164 is provided to a volumetric estimation step 166. Preferably, steps 160–166 are modeled on the computer of FIG. 1A.

After steps 160–166, the process of FIG. 1B performs actual laboratory verification in steps 170–174. In FIG. 1B, the second half starts with the process of performing a laboratory verification of various proposed JMF solutions that may satisfy the requirements. From step 170, the process of FIG. 1B proceeds to step 172 where a gyratory compact step is performed, preferably using a 3-points verification. From step 172, the process of FIG. 1B proceeds to step 174 where the actual volumetric properties are verified.

The process of FIG. 1B improves the efficiency of the user by minimizing the use of laboratory trial and error procedures. Promising JMFs could be quickly evaluated using the estimation process provided by the present invention. JMFs which do not promote compliance of desired specifications can be quickly eliminated from expensive laboratory testing, saving the user time, labor and money. Thus, the present invention uses basic engineering properties to evaluate the proposed JMF and to test the proposed JMF for verification of the desired volumetric properties and to optimize the binder content. The present invention thereby allows the user to rapidly determine whether the proposed JMF, including the combination of aggregates and asphalts that defines the actual gradation and asphalt content to be obtained in the finished construction, satisfies the mixture design.

Figure 1C:
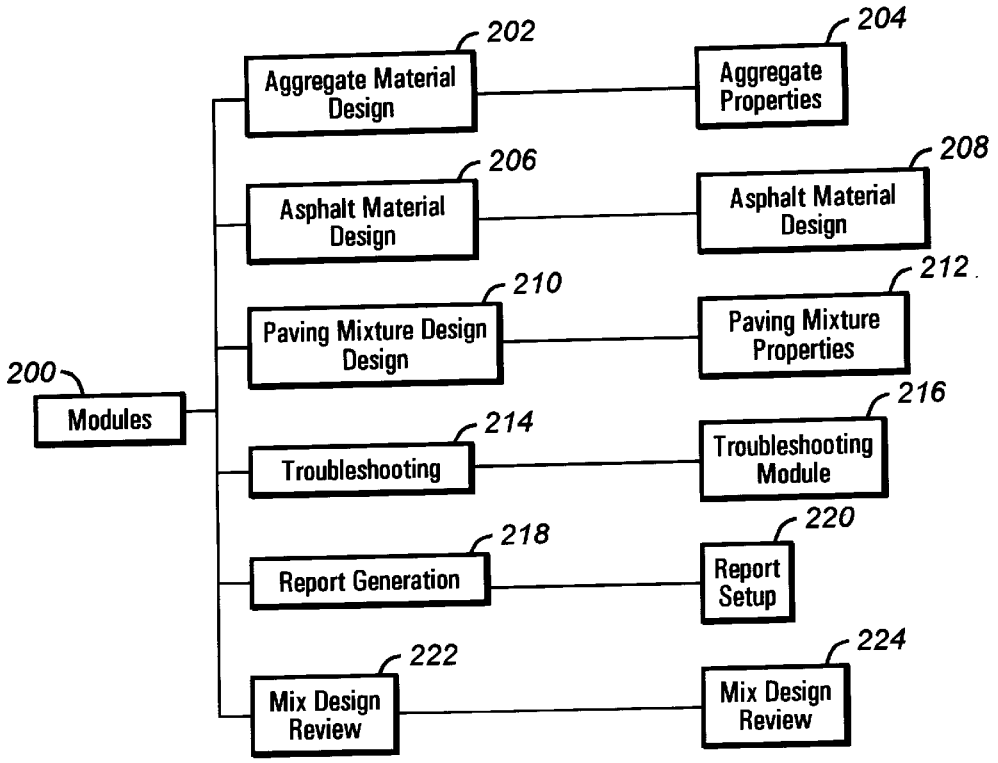
FIG. 1C is a block diagram of major modules of the mixture design system in accordance with the present invention.

Turning now to FIG. 1C, the process for efficiently estimating the job mix formula in accordance with various mix design methodologies, including the Marshall, Hveem, or SHRP mix design methodology is shown. Preferably, the process of FIG. 1C is a software executing on the computer system of FIG. 1A. The preferred software embodiment worlds with Microsoft's Windows operating system, including Windows-95 and Windows-NT, although any other suitable graphical operating system such as MacOS and Solaris can be used. Windows is a graphical-based operating environment, also known as a graphical user interface, or (GUI) that allows multitasking of programs. In Windows, the computer screen operates like a desktop, allowing instantaneous access to clocks, spreadsheets, word processing, communication software, graphics packages and, of course, this mix design program. The user is able to select rapidly among those applications, as well as any others developed for the environment. The ability to work simultaneously on several different projects more closely approximates the manner in which most people work. However, the user can work in one program at a time if desired. Preferably, the software of the invention is an object-oriented software constructed from Visual Basic, although it can be written in a number of other languages.

FIG. 1C shows the overview of different paving design modules provided by the present invention on the computer of FIG. 1A. In FIG. 1C, upon entry to the software of the present invention, a plurality of design modules are available to users. Thus, the user can select an aggregate material design module 202 which allows the user to define and design aggregate properties and gradations. The aggregate material design module 202 in turn calls an aggregate properties module 204. The aggregate properties module 204 defines physical and engineering properties of one or more aggregates, including but not limited to, sieve analysis, specific gravities and gradation.

Alternatively, the user can select an asphalt material design module 206 which addresses the chemical and physical design of various asphalt binders. The asphalt material design module 206 proceeds to call an asphalt material design routine 208 which defines asphalt material criteria, mixing and compacting temperature. These variables impact the asphalt material specification. The user can also select a paving mixture design module 210. This module allows the user to design a hot mix asphalt concrete (HMAC) volumetric properties. The paving mixture design module 210 in turn calls a paving mixture properties routine 212. The paving mixture properties routine 212 allows the user to design specific gravities, densities, void proportions, Marshall or Hveem stability, Marshall flow of mix.

Alternatively, the user can select a troubleshooting module 214 which provides general help on the various HMAC mix designs. If the troubleshooting is invoked, the troubleshooting module 214 in turn calls a troubleshooting routine 216 which is a simplified expert system that analyzes and displays mixing design issues and design problems with the user. Alternatively, the user can generate a report using a report generation option 218. The report generation option 218 in turn invokes a report setup module 220 which selects different types of reports and graphics to be automatically generated by the present invention. The user can also invoke a mix design review module 222 which is a help feature that enables the engineer to revisit the details of the design. The mix design review module 222 in turn calls a mix design review routine which provides a selection of options for the user to revisit.

Figure 2:
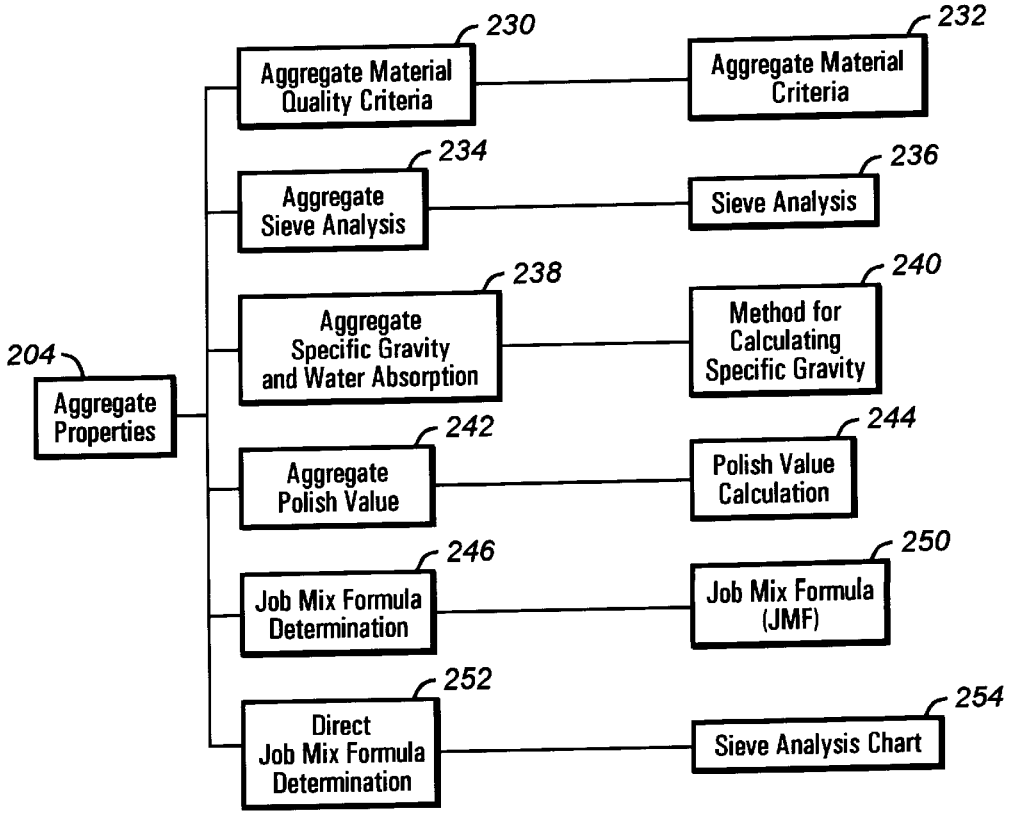
FIG. 2 is a flow chart illustrating an aggregate module of FIG. 1C in accordance with the present invention.

Referring now to FIG. 2, the aggregate properties routine 204 of FIG. 1C is discussed in more detail. In FIG. 2, from step 204, the aggregate properties routine displays a number of options. One option is an aggregate material quality criteria 230 which provides various quality control tests and evaluation. If invoked, the aggregate material quality criteria module 230 calls an aggregate material criteria routine. Alternatively, the user can specify an aggregate sieve analysis module 234. The aggregate sieve analysis module 234 in turn calls a sieve analysis routine 236 which separates the aggregate based on different sieve sizes. Furthermore, the user can also select an aggregate and specific gravity and water absorption module 238. This module performs a determination of bulk, saturated and apparent specific gravity in water absorption capacity by calling a calculation of specific gravity routine 240. Additionally, the user can also select an aggregate polish value module 242. This module identifies the aggregate with the highest possible polish value when it calls a polish value calculation routine 244. Furthermore, the user can also perform a determination of the appropriate blend of aggregates when he or she invokes a job mix formula determination module 246. The job mix formula determination module 246 in turn calls a job mix formula (JMF) routine 250, as discussed in detail below. Additionally, the user can also invoke a direct job mix formula determination module 252 which plots one or more generic JMFs without a prior determination of blend proportions. This is performed by calling a sieve analysis charting routine 254.

Figure 3:
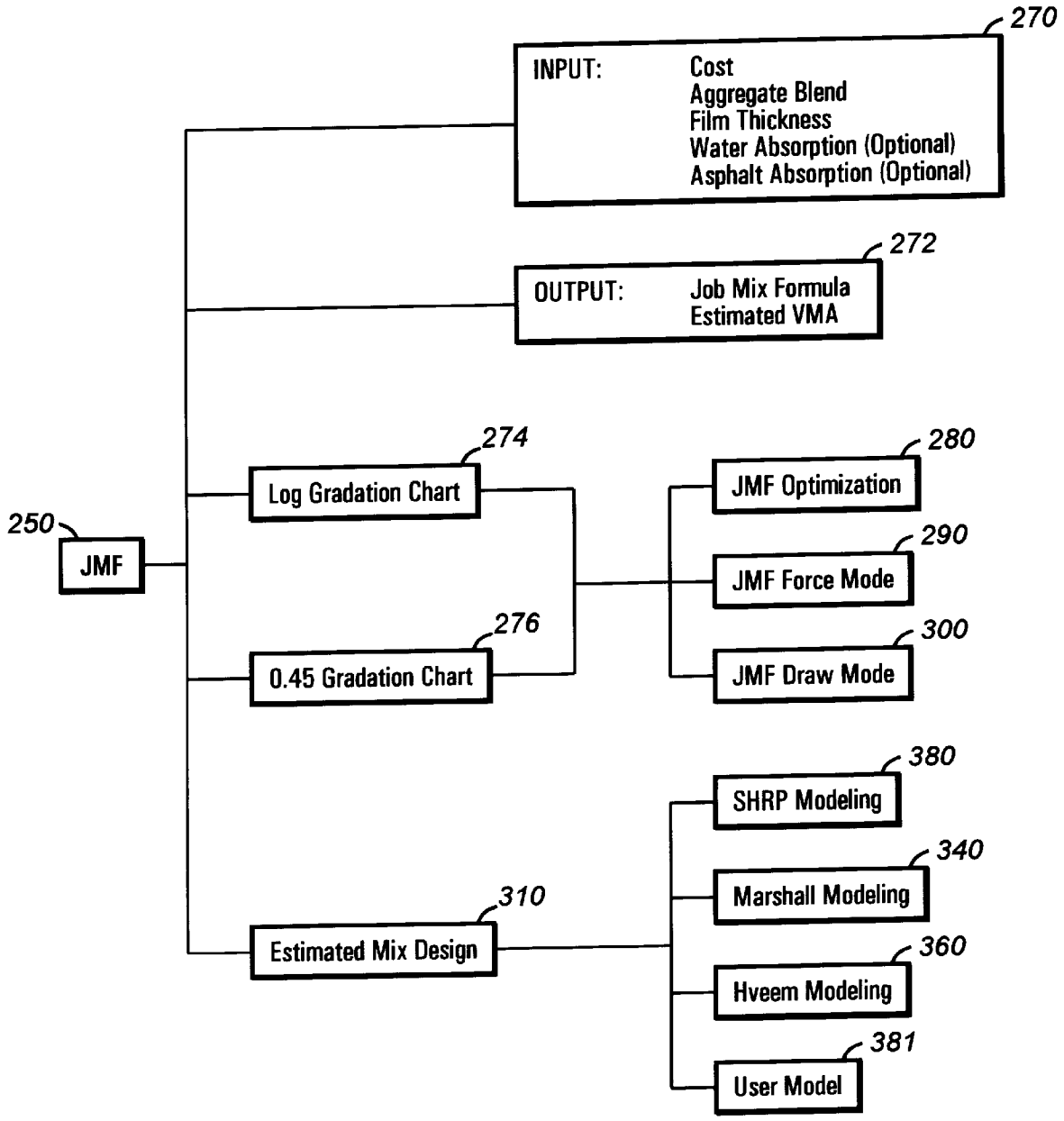
FIG. 3 is a flow chart illustrating a JMF process in accordance with the flow chart of FIG. 2.

Turning now to FIG. 3, the JMF routine 250 of FIG. 2 is illustrated in more detail. As shown in FIG. 3, the JMF module 250 receives a plurality of inputs in step 270. These inputs include cost, film thickness, water absorption, and aggregate blend, among others. Furthermore, the JMF routine 250 generates an output in step 272 which determines the job mix formula and an estimated VMA. The JMF routine 250 also allows a user to analyze the job mix formula on a log gradation chart in step 274. This step allows the user to pick a standard gradation chart where the x scale is a logarithmic scale. Alternatively, the user can also select a 0.45 gradation chart which is a standard gradation chart where the x scale is raised to the 0.45 power, as known in the art in step 276. Additionally, steps 274 and 276 allows the user to specify three possible modes of data entry. One mode is a JMF optimization mode 280, a JMF force mode 290 and a draw mode 300. The modes 280, 290 and 300 are discussed in detail in the Figures below. Furthermore, from the JMF module 250, the user can also perform an estimated mix design in step 310. Step 310 allows the user to predict the volumetric properties of the HMAC mix as specified in the different methodologies without the use of extensive laboratory testing and trial and error procedure. This step allows the user to select one or more modeling procedures, including a Marshall model in step 340, a Hveem model in step 360, a SHRP model 380, a user definable model 381, or any combinations thereof.

The Marshall Method of Mix Design is a HMAC mix design method that is applicable to mixes containing aggregates which maximum size is 1 inch. Initially developed by Bruce Marshall, the Marshall procedure has been modified by the U.S. Corps of Engineers, standardized and designated ASTM-D 1559. Once the aggregate blend has been selected and the specific gravity values of these aggregates determined, the engineer can then start the Marshall procedure. The Marshall mix design method is divided into four steps that are followed for each of the trial mixes: the preparation of the test specimens for different levels of asphalt content (ASTM D 1559), the determination of the bulk specific gravity (ASTM D 1188), that of the values of the Marshall stability and the flow (ASTM D 1559), and the unit weight and void determination. Using the data for all these trial mixes, test property curves and then plotted for percent air voids, $V_A$, percent VMA, unit weight of the mix (ASTM D 2726), stability and flow all versus asphalt content.

Alternatively, the Hveem method of mix design can be used. Developed by Francis N. Hveem, the Hveem method of mix design is applicable to paving mixtures containing aggregates of a maximum size of 1 inch, (25.4 mm). The method has been standardized and the test procedures are found in ASTM D 1560 and ASTM D 1561. Similar to the Marshall method, once the appropriate aggregate blend has been selected and the specific gravity values of these aggregates determined, the Hveem mix design procedure can then be started. In this process, using the data from trial mixes, test property curves are then plotted for percent air voids, $V_A$, percent VMA, unit weight of the mix (ASTM D 2726), and stability, all versus asphalt content.

The Strategic Highway Research Program (SHRP) method of mix design is a laboratory procedure based on volumetric design. The mix design focused on identify performance graded asphalt based on intend traffic levels and environmental conditions. SHRP Level 1 analysis does not include a strength test. The optimum binder corresponds to a 4 percent air void, provided satisfactory volumetric properties are acceptable. SUPERPAVE Level 1 mix design is a design technique developed under the Strategic Highway Research Program. Level 1 is used to estimate the suitability of an asphalt paving mixture design for a particular set of criteria which include the anticipated traffic level as well as climatic conditions at the paving site (i.e., temperature). Level 1 relies on the SUPERPAVE binder classification system (also developed under SHRP) to accurately grade the binder for the climatic conditions expected. Traffic level and traffic speed also play a part in the binder selection process. Level 1 design methods utilize the volumetric properties of a proposed aggregate skeleton to establish the optimum binder content for a particular aggregate blend. The asphalt content is optimized by selecting the amount needed to achieve 4% air voids at a particular number of gyrations on a SUPERPAVE Gyratory Compactor (SGC). The number of gyrations have been established from empirical data collected during the Strategic Highway Research Program.

Figure 4:
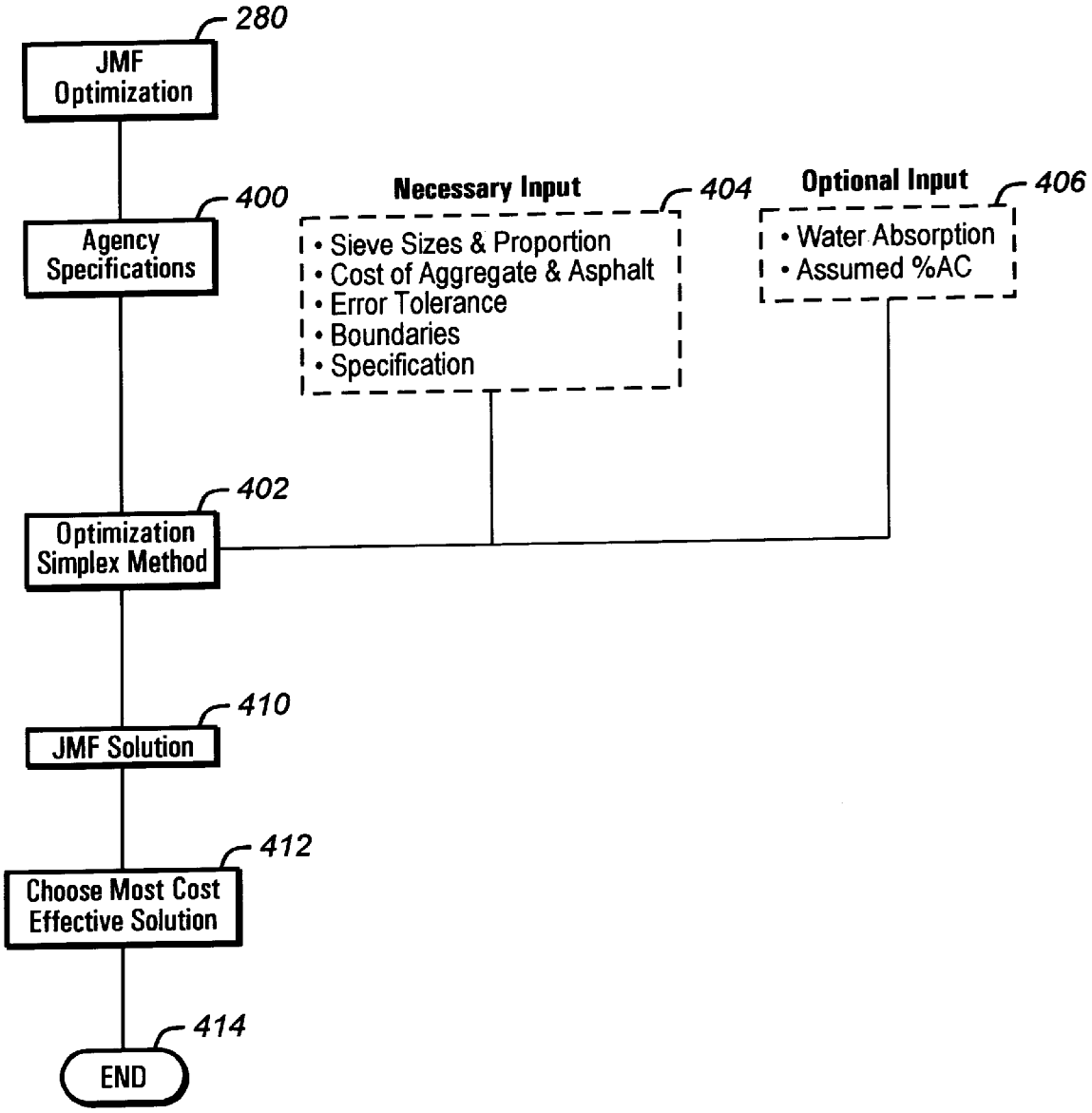
FIG. 4 is a flow chart illustrating a JMF optimization process of FIG. 3.

Turning now to FIG. 4, the JMF optimization routine 280 of FIG. 3 is illustrated in more detail. In FIG. 4, from step 280, the routine requests the user to enter agency specifications in step 400. Additionally, the user enters one or more necessary inputs in step 404, including sieve sizes and proportion, cost of aggregate and asphalt, error tolerance, boundaries and specification, among others. Additionally, the user is prompted to enter one or more optional inputs in step 406, including water absorption values, and assumed %AC, among others. The data provided in steps 400, 404 and 406 are provided to an optimizer 402. Preferably, the optimizer 402 uses the Simplex method. The optimizer helps the user to find an optimum set of aggregate proportions which satisfies the following conditions:

1. JMF curve inside the specific limits.
2. Aggregate proportions that satisfy user specified criteria.
3. Minimized cost for the total combined paving mixture (\$/ton).
4. Other actual or estimated mixture properties (VMA, VTM, Optimum Binder, etc. . . . ).

In the optimization process, the Gradation Formula is as follows:

$$JMF = A1*p1 + A2*p2 \ldots An*pn$$

where

JMF: The percentage of material passing a given sieve for the combined aggregates.

An: The percentage of material passing a given sieve for aggregate (n).

pn: The proportion of aggregate (n).

And $(p1+p2+\ldots+pn=1)$.

In matrix form, the formula becomes:

$$\begin{bmatrix} jmf1 \\ jmf2 \\ jmf3 \\ \vdots \\ jmfm \end{bmatrix} = \begin{bmatrix} A11 & A12 & A13 & \ldots & A1n \\ A21 & A22 & A23 & \ldots & A2n \\ A31 & A32 & A33 & \ldots & A3n \\ \vdots & & & & \\ Am1 & Am2 & Am3 & \ldots & Amn \end{bmatrix} * \begin{bmatrix} p1 \\ p2 \\ p3 \\ \vdots \\ pm \end{bmatrix}$$

The cost formula is as follows:

$$CT = C1 \times p1 + C2 \times p2 + \ldots Cn \times pn.$$

where

CT: Total cost (\$/ton).

Cn: Cost (%/ton), for aggregate (n).

At this step, all the solutions (p1, p2, . . . pn) which is minimum cost and satisfying user specified criteria are located. To solve the problem, the Simplex Method is used, as follows:

```
A11p1 + A12p2 + A13p3    . . . + A1npn > v1
A21p1 + A22p2 + A23p3    . . . + A2npn > v2
A31p1 + A32p2 + A33p3    . . . + A1npn > v3
        .                      .
        .                      .
        .                      .
Am1p1 + Am2p2 + Am3p3  . . . + Amnpn > vm
A11p1 + A12p2 + A13p3    . . . + A1npn < u1
A21p1 + A22p2 + A23p3    . . . + A2npn < u2
A31p1 + A32p2 + A33p3    . . . + A3npn < u3
        .                      .
        .                      .
        .                      .
Am1p1 + Am2p2 + Am3p3    . . . + Amnpn < um
    where f = h1.p1 + h2.p2 + h3.p3 + . . . + hn.n
    (h1,h2,h3 . . . hn) iteration (1 < = hi < = 5)
    (v1,v2,v3 . . . vm) lower limit of spec. gradation.
    (u1,u2,u3 . . . um) upper limit of spec. gradation.
```

Once the optimization has been performed in step 402, the routine of FIG. 4 proceeds to step 410 where it generates a plurality of JMF solutions. Once these JMF solutions have been generated, the routine of FIG. 4 selects the least cost solution in step 412 before it exits in step 410.

Figure 5:
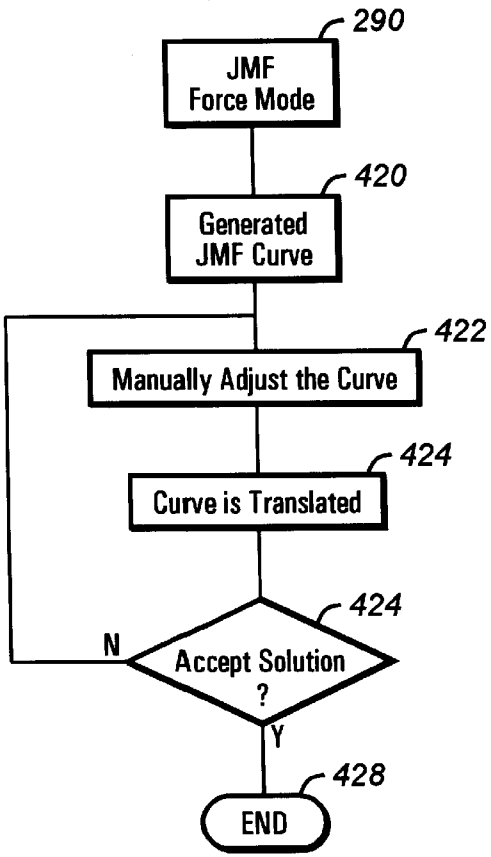
FIG. 5 is a flow chart illustrating a JMF data force process of FIG. 3.

Turning now to FIG. 5, the routine to enter JMF data using a force mode 290 of FIG. 3 is illustrated. In FIG. 5, after entering the routine in step 290, the routine of FIG. 5 requests the user generate a JMF curve in step 420. From step 420, the routine proceeds to step 422 where it allows the user to manually adjust the curve. Next, in step 424, the curve is translated such that the curvatures are minimized. From step 424, the routine of FIG. 5 proceeds to step 426 where it checks if the curve drafted is acceptable to the user. If not, the routine loops back from step 426 to step 422 to allow the user to edit the curve. Alternatively, in the event that the curve generated is acceptable to the user, the routine of FIG. 5 exits in step 420.

Figure 6:
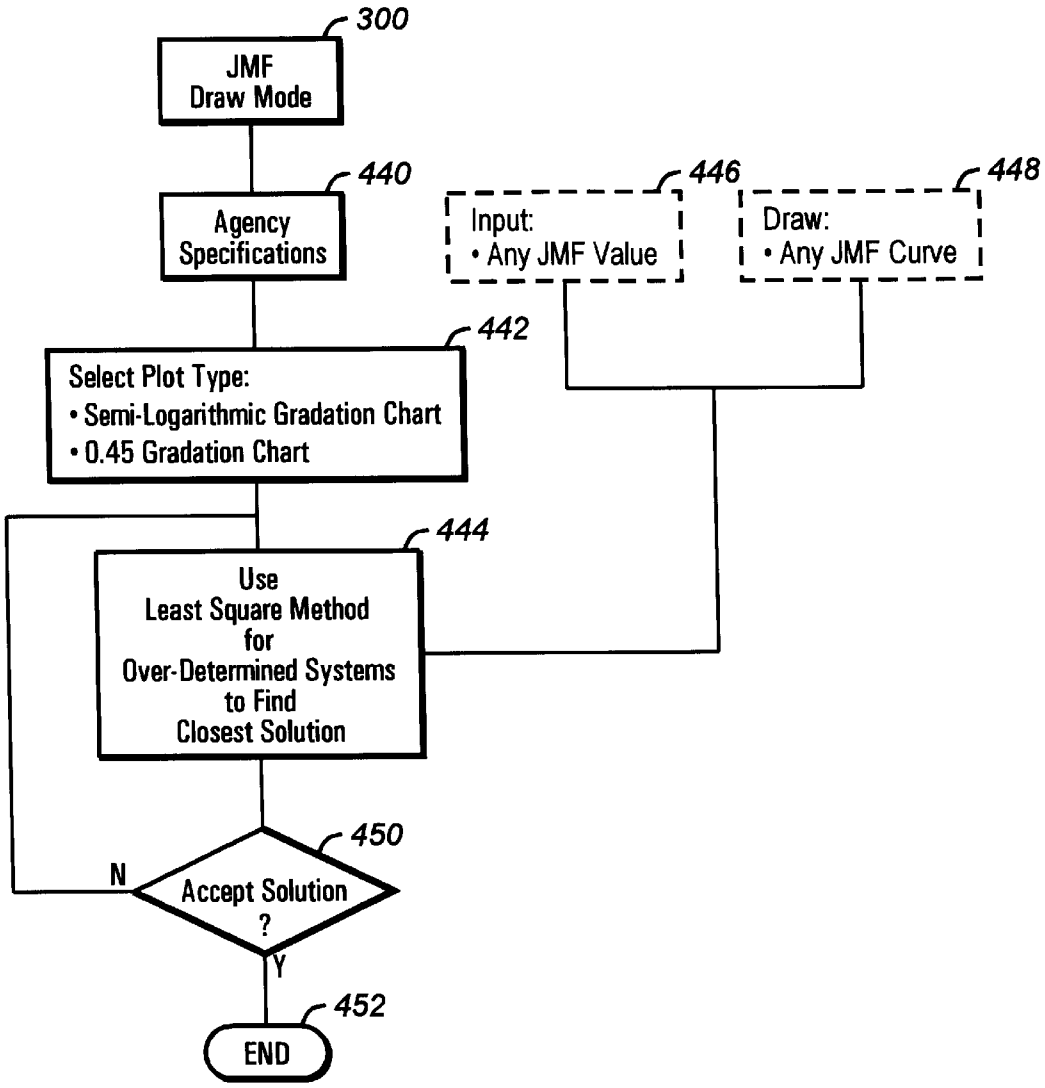
FIG. 6 is a flow chart illustrating a draw data process of FIG. 3.

Turning now to FIG. 6, the routine to perform data entry via a draw mode in FIG. 3 is illustrated in more detail. From step 300, the routine requests the user enter the agency specifications in step 440. From step 440, the routine proceeds to step 442 where it asks the user to select the particular plot type, including a semi-logarithmic gradation chart or a 0.45 gradation chart, among others. From step 442, the routine of FIG. 6 then proceeds to step 444 where it requests that the user applies a least square method for over-determined systems to find the closest solution.

Once the curve has been drawn, the computer of the present invention proceeds to find a solution. The process for solving the solution satisfactory to the drawn curve is based on a non-linear programming method called an "over determine" method. The method reduces a non-linear system Ax=b with more unknowns than equations to a linear system having the same number of equations and unknowns. The over determine solution method so that a residual vector R satisfies:

$$R=Ax-b$$

Preferably, the solution applies a least-squares solution. The least-squares solution of an overdetermined system is the vector x which makes the sum of the squares of the components of the residual vector a minimum, as follows:

$$R^TR=\text{minimum}$$

for m equations and n unknowns, with m>n, leading to the normal equations:

$$(a_1, a_1)x_1+ \ldots +(a_1, a_n)x_n=(a_1, b)$$

$$(a_n, a_1)x_1+ \ldots +(a_n, a_n)x_n=(a_n,b)$$

which determine the components of x. Here $$(a_i,A_j)=a_{1i}a_{1j}+ \ldots +a_{mi}a_{mj}$$

is the scalar product of two column vectors of A.

Once a solution has been found, the curve will be adjusted and converted into a gradation. In this manner, a more efficient, rapid, flexible and powerful method of drawing the JMF curve and determining the JMF gradation for HMAC mixture is achieved by the present invention.

In addition to the data entered in steps 440 and 442, step 444 also accepts optional data in steps 446 and 448 to accept any JMF values or to draw JMF values, respectively. From step 444, the routine proceeds to step 450 where it checks if the solution is acceptable to the user. If not, the routine loops back to step 442 to allow the user to continue editing the draw mode data entry. Alternatively, in the event that the solution is acceptable to the user, the routine of FIG. 6 proceeds from step 440 to step 452 to exit the routine.

Figure 7:
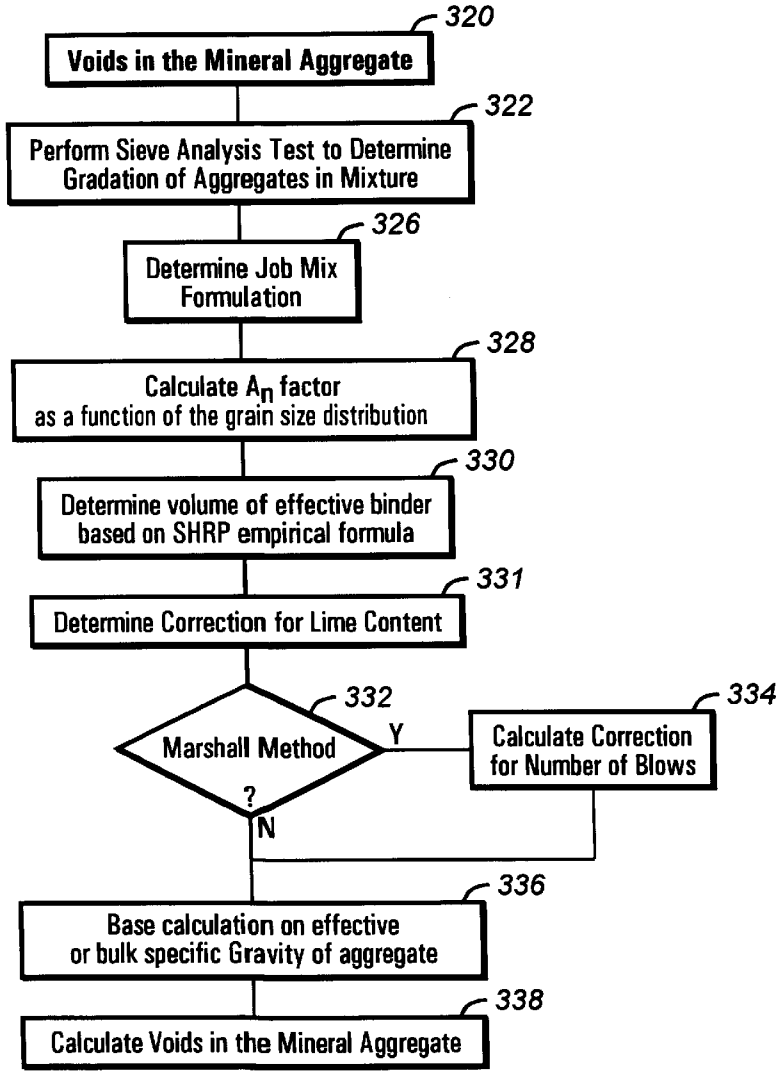
FIG. 7 is a flow chart of the process in determining the voids in the mineral aggregate.

Referring now to FIG. 7, the process for determining the voids in mineral aggregate (VMA) is shown in more detail. As a percent of the weight of the total mixture, the percent VMA, %VMA, is given by:

$$\%\,VMA = 100 - \frac{G_{MB} * P_s}{G_{SB}}$$

where $P_S$ is the aggregate content, expressed as a percentage of the total weight of the mix, $G_{MB}$ the bulk specific gravity of the mix, and $G_{SB}$ the bulk specific gravity of the aggregate. It can also be expressed as a function of the asphalt content, %AC, as follows:

$$\%\,VMA = 100\left(1 - \frac{G_{MB}}{G_{SB}} * \frac{100}{100 + \%\,AC}\right)$$

The present invention provides an estimate of the %VMA that does not require the determination of the bulk specific gravity of the mix, $G_{MB}$. The estimated percentage of Voids in the Mineral Aggregate in the total volume, $\%VMA_{est}$ in %, can be defined by the following equation from the Asphalt Institute MS-2 manual as:

$$VMA_{est}=V_A+V_{BE}$$

where $V_A$, in %, is the proportion by total volume of air contained in the total mix, and $V_{BE}$, in %, is the proportion by total volume of the effective asphalt binder.

Air voids are small air spaces that are between the coated particles. The percent air voids in the total compacted paving mix; $V_A$, is expressed as a percentage of the total volume of the mix, and is given by:

$$V_A - 100 * \frac{G_{MM} - G_{MB}}{G_{MM}}$$

where $G_{MB}$ is the bulk specific gravity of the mix, and $G_{MM}$ is the maximum theoretical specific gravity. Preferably, one of the targets of mix design is to achieve a value of air contained in the total mix, $V_A$, equal to 4%. The value of $V_A$ is therefore assumed to be equal to 4%. The value of $V_{BE}$ is generated by using the following equality:

$$V_{BE}=(100+A_n)*V_{BEO.45}$$

Where $V_{BEO.45}$ is the proportion by total volume of the effective binder for a mix of maximum density, and $A_n$ is a factor, the percent, based on the grain size distribution of the aggregates in the mix. The plot of a dense mix with all the voids filled with aggregate would appear as a straight line on the 0.45 gradation curve. The equation for the proportion of such a mix is given by the following regression equation, from the "Superpave™, Asphalt Mix Design and Analysis" manual. The value of $V_{BEO.45}$ is determined by:

$$V_{BEO.45}=0.081-0.02931*Ln|S_n|$$

Where $S_n$ is the maximum sieve size of the aggregate, in inches. In the ATSER method, this value is defined as that of the maximum sieve size of the gradation.

Preferably, $A_n$ is generated by computing the area between the actual Job Mix Formula (JMF) and the 0.45 straight line (M). The value of $A_n$, in percent, is calculated as follows:

$$A_n = \frac{1}{2} * \sum_{i=1}^{n} (D_{i+1}^{0.45} - D_i^{0.45}) * (|JMF_{i+1} - M_{i+1}| + |JMF_i - M_i|)]$$

where $D_i$ is the $i^{th}$ sieve size, in inches, $JMF_i$ is the total percentage passing at the $i^{th}$ sieve size on the 0.45 curve, in percent, and $M_i$ is the total percentage passing at the $i^{th}$ sieve size as measured on the maximum density line, in percent.

Referring now to FIG. 7, upon entry to FIG. 7 via step 320, the routine proceeds to step 322 where it performs a sieve analysis to determine the gradation of aggregates in the mixture in step 322. From step 322, the routine proceeds to step 326 where it determines data relating to the job mix formulation (JMF).

From step 326, the routine proceeds to step 328 where it determines the factor $A_n$ as based on the grain size distribution. Next, in step 330, the routine generates a number relating to the total volume of the effective binder. From step 330, the routine proceeds to step 331 where it determines the correction factor for the lime content. From step 331, the routine proceeds to step 332 where it checks if the mix methodology to be applied is the Marshall methodology. If so, the routine proceeds to step 334 where it determines the correction factor for the number of blows. From step 334 or from step 332 in the event that the method is not the Marshall method, the routine proceeds to step 336. In step 336, the routine prompts the user to select the option, based on the VMA calculations, on effective or bulk specific gravity for the aggregates. From step 336, the routine proceeds to step 338 where it determines the VMA value before exiting.

Figure 8:
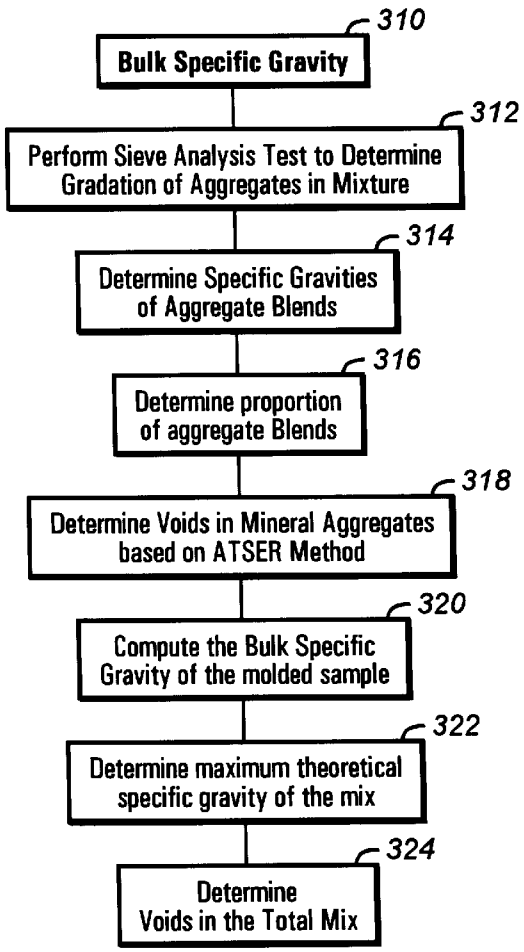
FIG. 8 is a flow chart illustrating in more detail the generation of the bulk specific gravity data.

The process for determining the bulk specific gravity is shown in more detail in FIG. 8. As illustrated therein, from step 310, the routine proceeds to step 312 where it performs a sieve analysis. Next, in step 314, the routine determines the Job Mix Formulation and further determines the specific gravity of the aggregates in Step 316. From step 316, the routine proceeds to step 318 where it determines the voids in mineral aggregates (VMA) based on the method of FIG. 7 before moving to step 320 where it computes the bulk specific gravity of the molded sample. The routine then determines the maximum theoretical specific gravity of the mix in step 322. Further, the routine determines the voids in the total mix in step 324 before it exits. Thus, using the process shown in FIG. 8, the present invention provides a more efficient way to estimate the bulk specific gravity. Thus, the engineer avoids trial batches and only runs the necessary tests to confirm his or her calculations. The resulting saving in time, effort and money is significant.

Figure 9:
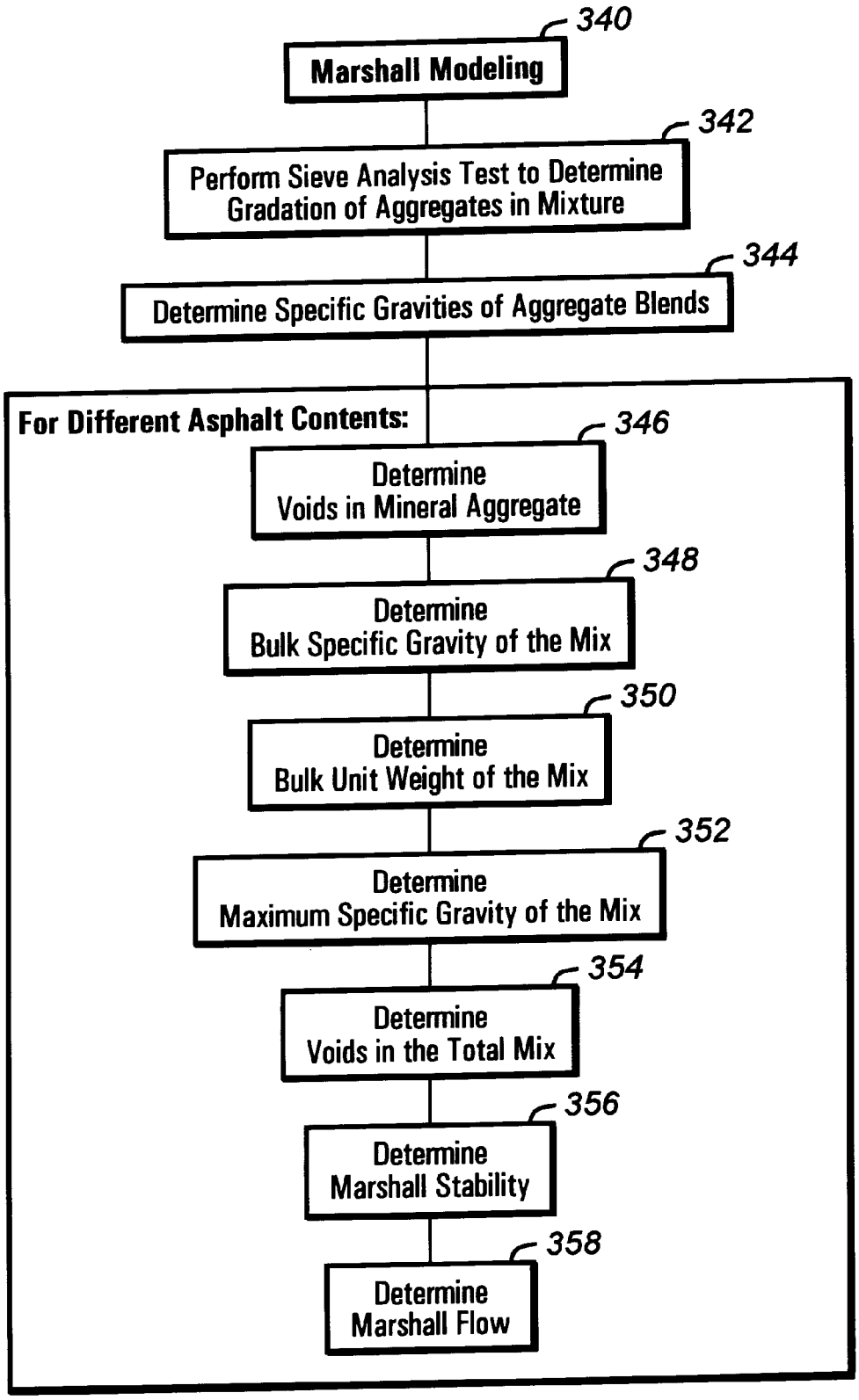
FIG. 9 is a process illustrating the process in Marshall Modeling processing step of FIG. 3.

Turning now to FIG. 9, the routine for generating data in accordance with the Marshall Mix methodology is shown in more detail. Generally, the procedure to develop an estimate of a Marshall mix design procedure performs a sieve analysis to determine the gradation of the aggregates in the mix, calculates the estimate of the percent void in the Mineral Aggregate, % estimated VMA, and $G_{mb}$, determines the bulk unit weight $\gamma_{mb}$, and plot it for different values of asphalt content, determines the maximum theoretical specific gravity, $G_{mm}$, and plots it for different values of asphalt content. Next, the process determines the percentage by total volume of the mix of air voids, $V_a$, and plots it for different values of asphalt content, determines the Marshall stability, $S_M$ in pounds, and plots it for different values of asphalt content. Finally, the process determines the flow and plots it for different values of asphalt content.

Upon entry to the routine in step 340, the routine performs a sieve analysis test to determine the gradation of the aggregates in the mixture in step 342. Next, in step 344, it determines specific gravities of aggregate blends in step 344. Once step 344 is completed, the routine performs steps 346–358 for a variety of asphalt contents.

For each asphalt contents, the routine of FIG. 9 determines a percentage void in the mineral aggregate (VMA) in step 346. Because the Marshall method defines three types of compaction efforts, the estimated VMA has to be adjusted for the number of hammer blows in step 346 as follows:

$$VMA_{est}=V_A+V_{BE}+\Delta VMA_{Blow}+\Delta VMA_{Lime}$$

Where $\Delta VMA_{Blow}$ is the correction for the number of blows, and $\Delta VMA_{Lime}$ is the correction for the number of blows. $\Delta VMA_{Blow}$ is given in Table 1:

TABLE 1

$\Delta VMA_{Blow}$ Correction

| Blows | $\Delta VMA_{Blow}$ |
|---|---|
| 35 | +0.3 |
| 50 | 0 |
| 75 | −0.3 |

The correction for lime, $\Delta VMA_{Lime}$, is a function of the percentage of lime, % Lime is given:

$$\Delta VMA_{Lime}=1.5*(\%\ \text{Lime}-1)+1$$

Although the use of lime is discussed, the present invention contemplates that any other mineral filler may be used in place of lime. From step 346, the routine proceeds to step 348 where it determines a bulk specific gravity for different asphalt contents and plots these results. Based on that corrected estimate of %VMA, the bulk specific gravity, $G_{mb}$, can then be determined as:

$$G_{mb} = \left(\frac{100 - \%\ VMA_{EST}}{100 - \%\ AC}\right) * G_{se}$$

where %AC is the percentage of asphalt by weight of the total mix, and $G_{se}$ the effective specific gravity of the aggregate. The value of $G_{se}$ is given by:

$$G_{se}=1.023*G_{sb}$$

where $G_{sb}$ is the bulk specific gravity of the aggregate. The unit weight of the mix, $\gamma_{mb}$, can then be determined in step 350 as follows:

$$\gamma_{mb}=G_{mb}*\gamma_o$$

where $\gamma_o$ is the unit weight at standard conditions of temperature and pressure, which is equal to 62.4 Lb/ft$^3$ or 1000 kg/m$^3$.

The percentage of air voids by volume of the total mix, $V_A$, is then determined as a function of the bulk specific gravity of the mix, $G_{mb}$, and the maximum theoretical specific gravity of the mix, $G_{mm}$:

$$V_A = 100*\left(1 - \frac{G_{mb}}{G_{mm}}\right)$$

Next, from step 350, the routine proceeds to step 352 where it determines the maximum specific gravity. The maximum theoretical specific gravity of the mix, $G_{mm}$ is computed as follows:

$$G_{mm} = \frac{100}{\frac{100 - \%AC}{G_{se}} + \frac{\%AC}{G_{AC}}}$$

From step 352, the routine proceeds to step 354 where it determines the percentage of the total volume mixture of air voids for different asphalt contents. Furthermore, the routine plots the computed total volume in step 354. From step 354, the routine proceeds to step 356 where it determines the Marshall Stability values for different asphalt contents. Preferably, a Marshall stability, $S_M$ in lbs., relates to the estimated percent VMA and $V_a$ as follows:

$$S_M=K_1*(\%VMA-K_2)^2*(-\%AC^2+9.33*\%AC-13.17)$$

where the $K_1$ and $K_2$ are empirical factors that are function of the number of compaction blows, and that are taken as shown in Table 2.

TABLE 2

| $K_2$ | K1 | BLOWS |
|---|---|---|
| −0.3 | +1.0 | 35 |
| 0 | +1.5 | 50 |
| +0.3 | +2.0 | 75 |

The different Marshall stability values are plotted in step 356. From step 356, the routine then determines and plots the Marshall Flow Values for the various asphalt content in step 358 before the routine of FIG. 9 exits. The Marshall flow is preferably generated by the following equation:

$$\text{Flow} = K_3 * \frac{S_H}{1000} * (\%AC^2 - 8.36 * \%AC + 20.62)$$

Where $K_3$ is an empirical factor that is function of the Marshall stability, $S_M$, and is shown in Table 3.

TABLE 3

| $S_M$ | $K_3$ |
|---|---|
| $S_M \leqq 2100$ | 1.285 |
| $2100 < S_M \leqq 3000$ | 1 |
| $S_M > 3000$ | 0.5 |

Figure 10:
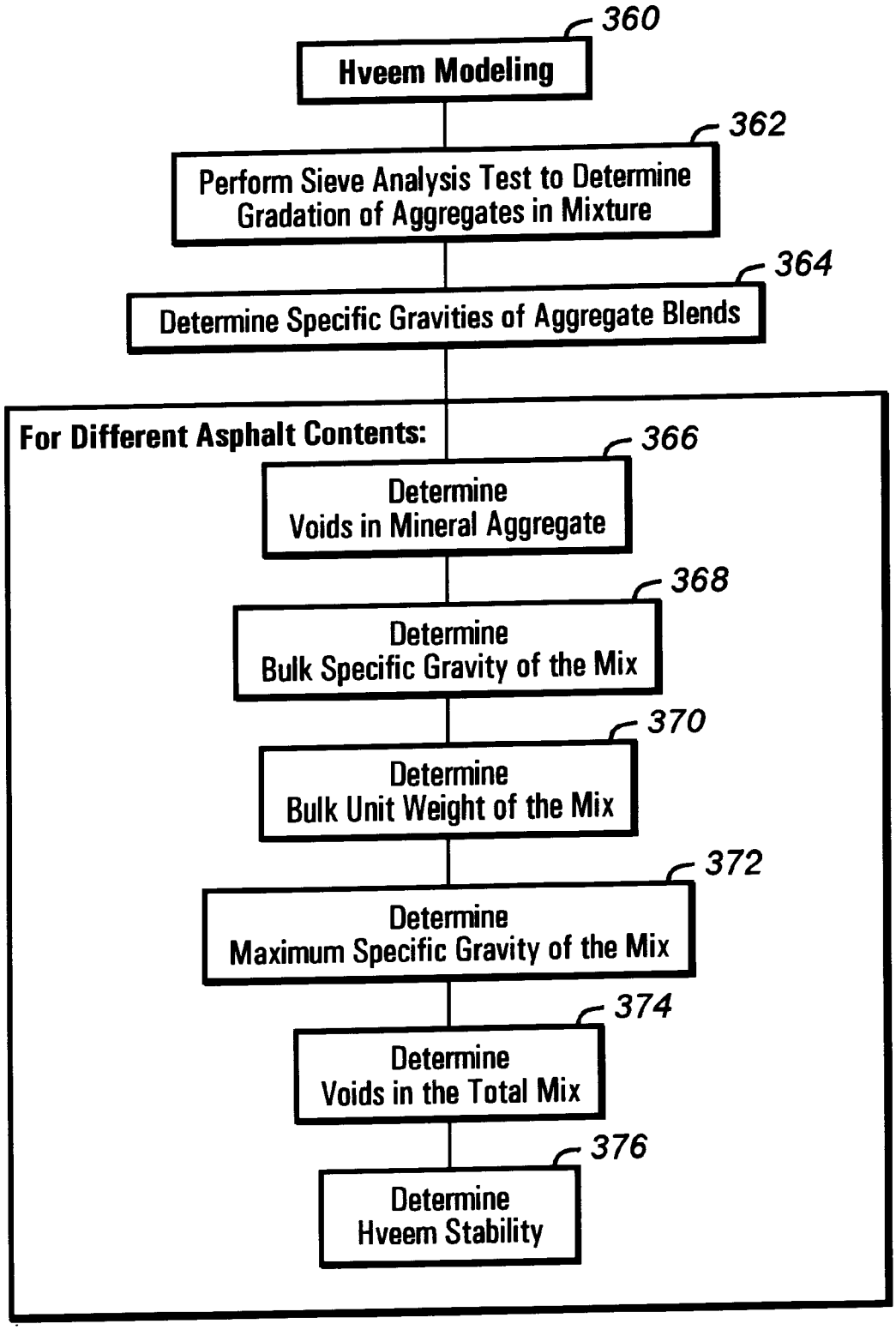
FIG. 10 is a flow chart illustrating in more detail the Hveem Modeling processing step of FIG. 3.

Turning now to FIG. 10, the process for performing the Hveem mix design methodology is shown in more detail. Generally, the procedure to develop an estimate of a Hveem mix design procedure performs a sieve analysis to determine the gradation of the aggregates in the mix, estimates of the percent Void in the Mineral Aggregate, $\%VMA_{EST}$, calculates $G_{mb}$, determines the bulk unit weight, $\gamma_{mb}$, and estimates these values for different values of asphalt content. Further, the procedure determines the maximum theoretical specific gravity, $G_{mm}$, and plot it for different values of asphalt content. The procedure next determines the percentage by total volume of the mix of air voids, $V_A$, and plots it for different values of asphalt content, determines the Hveem stability, $S_H$ in pounds, and plots it for different values of asphalt content.

In FIG. 10, from step 360, the routine proceeds to step 362 where it performs a sieve analysis to determine the gradation of aggregates in the mixture. From step 362, the routine then proceeds to step 364 where it determines specific gravities of the aggregate blends. Next, in step 366, the routine of FIG. 10 computes a percentage of void in mineral aggregate (VMA). Based on the preferred method for estimating the percent void in the Mineral Aggregate, $\%VMA_{est}$, of FIG. 7, the present invention determines a bulk specific gravity of the mix, $G_{mb}$, the unit weight of the mix, $\gamma_{mb}$, and the percentage of air voids by volume of the total mix, $V_a$, the maximum theoretical specific gravity of the mix, $G_{mm}$.

From step 366, the routine proceeds to step 368 where it determines the bulk specific gravity for various aggregates. Next, the routine determines the bulk unit weight for different asphalt contents and plots these results in step 370. From step 370, the routine proceeds to step 372 where it determines the maximum specific gravity for different asphalt contents and also plots them.

From step 372, the routine proceeds to step 374 where it determines the percentage of the total volume of mixture of air voids for different asphalt contents. Furthermore, it plots these results. From step 374, the routine proceeds to step 376 where it determines the Hveem stability values for the different asphalt contents. The Hveem stability is as follows:

$$S_H=1.48*V_a+2.426*\%VMA_{est}$$

The Hveem stability values are also plotted before the routine exits FIG. 10.

Figure 11:
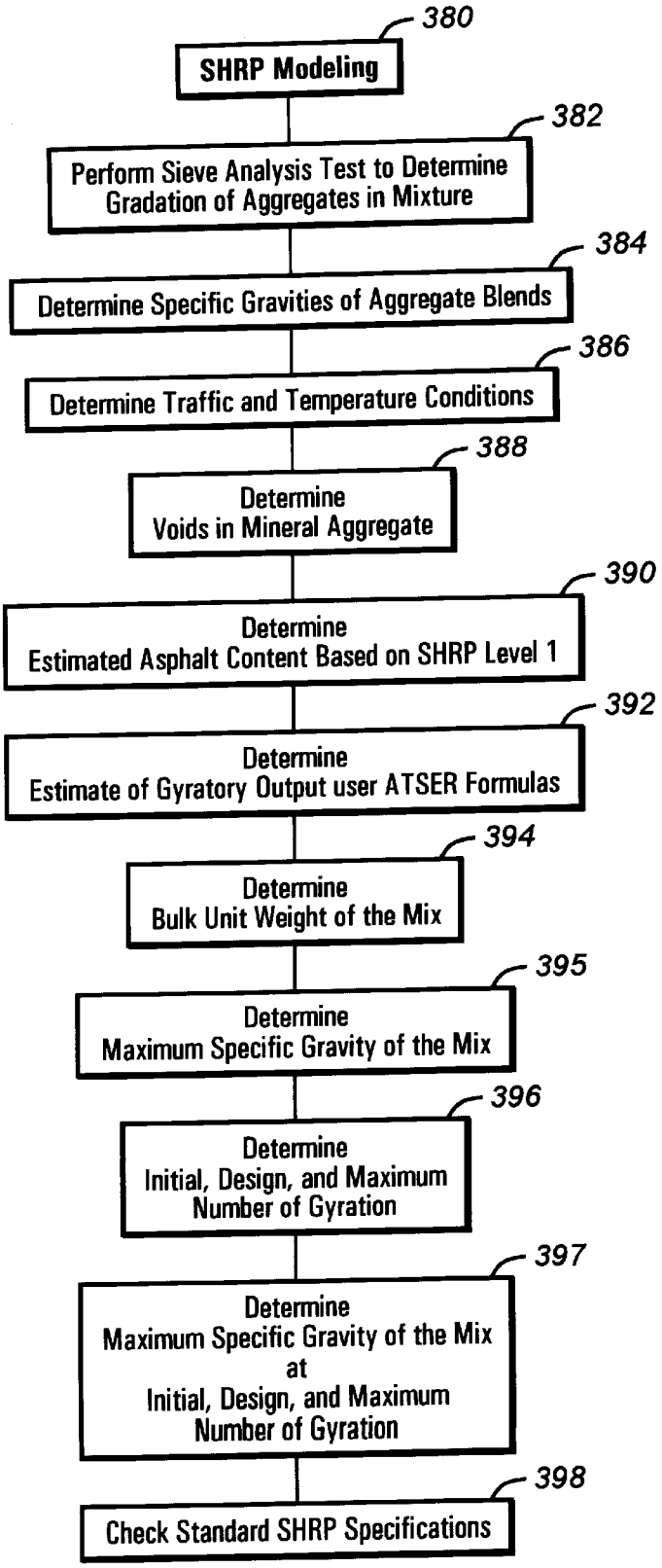
FIG. 11 is a flow chart illustrating in more detail the SHRP Modeling step of FIG. 3.

Turning now to FIG. 11, the process for conforming to the SHRP Mix methodology is shown in more detail. The estimated SHRP mix design is based on the preferred method of estimating the percent voids in the mineral aggregate, $\%VMA_{est}$, and on an empirical equation that replicates the results of the SHRP gyratory compactor. The procedure is the same as the SHRP calculation procedure except for the fact that the results of the gyratory compactor are estimated by the preferred method of modeling the SHRP gyratory compactor. Generally, the procedure to develop an estimate of a SHRP mix design procedure performs a sieve analysis to determine the gradation of the aggregates in the mix and calculates the estimate of the percent void in the mineral aggregate, $\%VMA_{est}$.

In FIG. 11, from step 380, the routine proceeds to step 382 where is performs a sieve analysis to determine the gradation of aggregates in the mixture. Furthermore, in step 384, the routine determines the effective specific gravity for fine, intermediate and coarse gradations. The effective specific gravity for each of the three blends, $G_{se}$, is determined as a function of the bulk specific gravity of the aggregate in the blend, $G_{sb}$, and of the apparent specific gravity of the mix, $G_{sa}$. It is given by:

$$G_{se}=G_{sb}+0.8*(G_{sa}-G_{sb})$$

Next, in step 386, the routine determines traffic and temperature conditions that the pavement is expected to encounter. From step 386, the routine proceeds to step 388 where it determines the VMA as discussed above.

From step 388, the routine proceeds to step 390 where it determines the asphalt content based on SHRP level 1 specifications. Here, the percent volume of asphalt binder in the aggregates and determines the effective volume of asphalt binders. The percent volume of the asphalt binder, $V_{ba}$, is determined for a case when the sample has a 5% asphalt content by total weight of mix, a 95% aggregate percentage by total weight of mix, and a 4% air voids by total volume of mix. The percent volume of the asphalt binder is then given by:

$$V_{ba} = \frac{95*(100-4)*\left(\frac{1}{G_{sb}} - \frac{1}{G_{se}}\right)}{\frac{5}{G_{AC}} + \frac{95}{G_{se}}}$$

Where %AC is the percent of asphalt by weight of mixture, $V_a$ is the percent air voids, $P_s$, is the percent of aggregates by weight of binder, $\%AC_{est}$, is determined as follows:

$$\%AC_{est} = 100*\frac{G_{AC}*(V_{be}+V_{ba})}{G_{AC}*(V_{be}+V_{ba})+W_s}$$

where $W_s$, the weight of aggregates is estimated for a 95% aggregate percentage by total weight of mix, and a 4% air voids by total volume of mix,. It is given by:

$$W_s = \frac{95*(1-0.04)}{\frac{5}{G_{AC}} + \frac{95}{G_{se}}}$$

In step 392, the routine estimates the gyratory output. The height of the sample in the SHRP gyratory compactor, h, is a function of the estimated asphalt content, $\%AC_{est}$, the initial height, $h_o$, and the number of gyrations, the preferred embodiment uses an empirical method that determined h as follows:

$$h=h_o-\%AC_{est}*Ln|N|$$

where N is the number of gyrations.

The volume of the sample, $V_{est}$, is then estimated as a function of the diameter of the sample in the gyratory compactor, d, and the estimated height, h. It is given by:

$$V_{est} = \frac{\pi}{4}*d^2*h*0.001$$

In step 394, the routine determines the bulk specific gravity of the aggregates. The bulk specific gravity, $G_{sb}$, and the maximum theoretical specific gravity of the mix $G_{mm}$, is determined in an analogous manner to that of FIG. 9. Further, in step 394, the estimated bulk specific gravity of the mix, $G_{mb,est}$, is then computed as:

$$G_{mb,est} = \frac{W_s\gamma_o}{V_{est}}$$

Next, in step 395, the routine determines a maximum specific gravity for the mix. In step 396, the routine determines parameters associated with initial, design and maximum number of gyrations before proceeding to step 397.

Next, in step 397, the routine computes a correction factor and generates a corrected bulk specific gravity. The routine also generates a percentage corrected maximum specific gravity value. The SHRP correction factor C is calculated as follows:

$$C = \frac{G_{mb,est}@\%VMA_{est}}{G_{mb,est}@Nmax}$$

The corrected bulk specific gravity of the mix, $G_{mb,corr}$, is then computed as:

$$G_{mb.corr}=C*G_{mb,est}$$

Furthermore, it determines the percentage of air voids and the percentage of voids in the mineral aggregate. The percent of the correct maximum specific gravity of the mix, is then computed as a ratio of the corrected bulk specific gravity of the mix, $G_{mb,corr}$, and the maximum theoretical specific gravity of the mix, $G_{mm}$. The percent of the correct maximum specific gravity of the mix, $G_{mm,corr}$, is given by:

$$\%G_{mm,corr} = 100*\frac{G_{mb,corr}}{G_{mm}}$$

The percent air voids, $V_a$, is then determined as:

$$Va=100-\%\ G_{mm,corr}@N_{des}$$

The percent voids in the mineral aggregate, %VMA, is then determined as:

$$\%VMA = 100-\%G_{mm}@N_{DES}*G_{mm}*\frac{100-\%AC_{EST}}{G_B}$$

From step 397, the routine of FIG. 11 proceeds to step 398 where it checks the generated values against the standard SHRP specifications.

Figure 12:
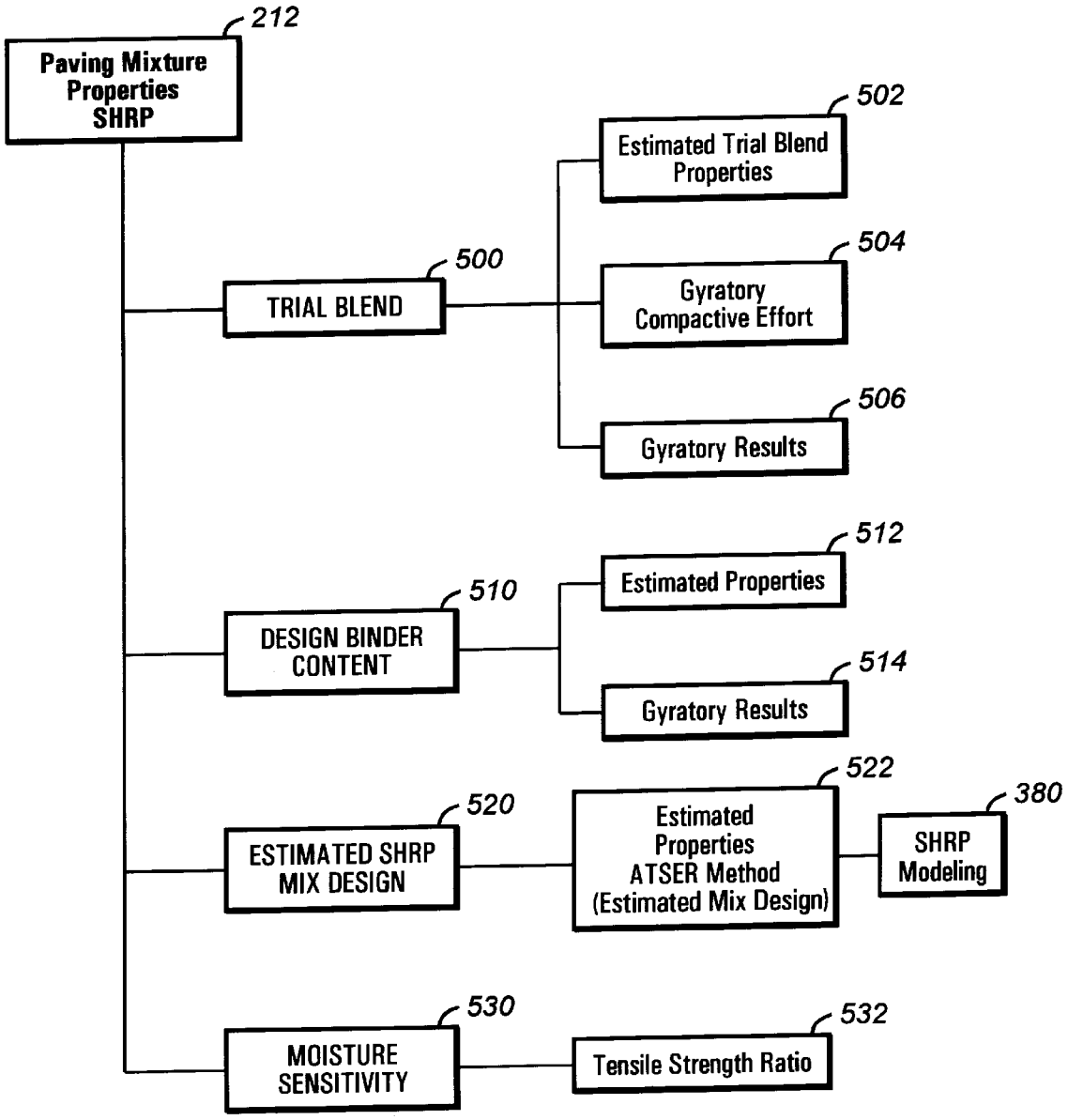
FIG. 12 is a flow chart illustrating in more detail the generation of the paving mixture properties process of FIG. 1C.

Turning now to FIG. 12, the routine to process the SHRP paving mixture properties 212 of FIG. 1C is illustrated in more detail. In FIG. 12, from step 212, the routine displays a plurality of options, including a trial blend module 500, a design binder content module 510, an estimated SHRP mix design module 520, and a moisture sensitivity analysis module 530.

In the event that the user selects the trial blendmodule 500, the routine of FIG. 12 allows the user to further select an estimated trial blend property module 502, a gyratory compactive effort module 504 which determines the number of gyrations as a function of traffic and temperature conditions, and a gyratory result module 506 which extracts the different sample heights from the SHRP territory and computes the VMA values for different levels of simulated fill compaction at a specific asphalt content. In this manner, the trial blend module 500 enables a user to perform trial and error procedures to find the adequate blend that satisfies for use as a design.

In the event that the user selects the design binder content module 510, the user is presented with two choices: an estimated properties module 512 which estimates mixed properties at 4% air voids and selects the appropriate blend from the final design, and a gyratory results module 514 which allows the user to test the selected blend at various asphalt contents. In this manner, the design binder content module 510 allows the user to determine an optimum asphalt content.

The user can also select an estimated SHRP mix design module 520. In such event, the module 520 invokes an estimated properties ATSER method module 522 for estimating the mix design. The module 522 in turn calls the SHRP model 380, as previously discussed. The user can also select a moisture sensitivity analysis 530 which determines the tensile strength ratio. If this option is selected, the user is prompted to perform the tensile strength ratio analysis in step 532.

Figure 13:
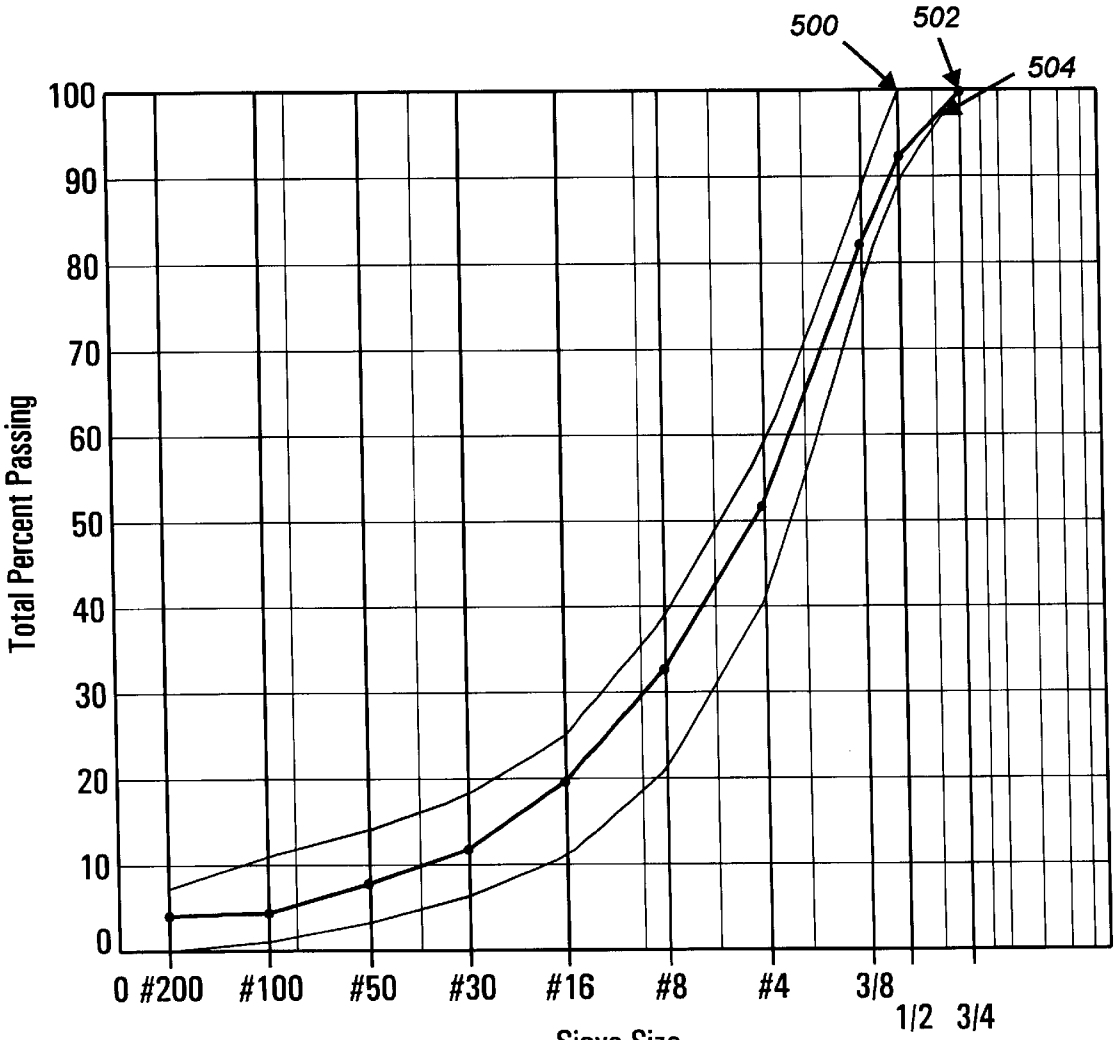
FIG. 13 is a diagram illustrating a semi-log gradation curve having outer boundaries relating to master limits of the specification and a middle line showing the proposed JMF.
Figure 14:
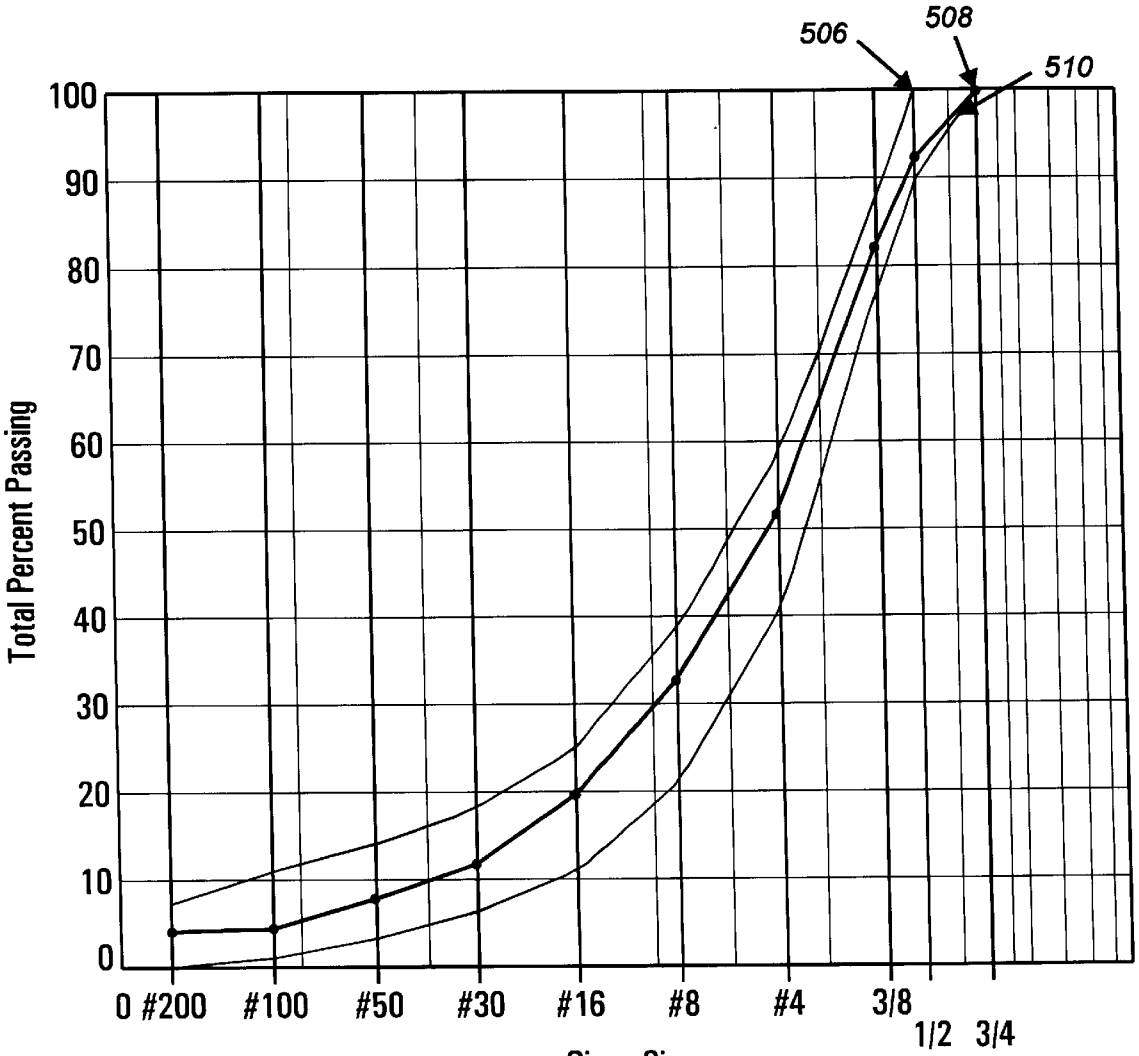
FIG. 14 is a chart illustrating the optimized semi-log gradation curve in accordance with the results of FIG. 13.

FIGS. 13 and 14 illustrate a typical semi-log gradation curve as entered by the user and the optimized semi-log curve as provided by the optimization routines discussed in FIG. 5. In FIGS. 13 and 14, the gradation curves are plotted with X and Y coordinates, for which the X coordinate represents the sieve size, plotted in a logarithmic scale while the Y coordinates represents the total percent by weight passing for a given sieve size on a linear scale. Lines 500, 504, 506 and 510 of FIGS. 13 and 14 relate to the master points or constraints that the specification requires. Most agencies specify minimum and maximum limits, as shown in lines 504 and 500, respectively. The proposed JMF or the blend of aggregates, shown as darkened lines 502 of FIG. 13 and 508 of FIG. 14 must be within the minimum and maximum limits. However, the minimum and maximum limits may be varied, according to the intended use of the agency.

FIG. 14 illustrates the results of an optimized JMF for the semi-log curve of FIG. 13. The optimization techniques performed by the present invention identify particular JMF blends that satisfy the mid-points between the master gradation limits of lines 500, 504, 506 and 510 of FIGS. 13 and 14. Thus, after optimization, the dark line 508 is positioned midway between the upper and lower master limit points in the upper and lower lines 506 and 510. The line 508 is generated in part by solving the linear programming problem in accordance with the simplex method, as discussed in FIG. 7.

Figure 15:
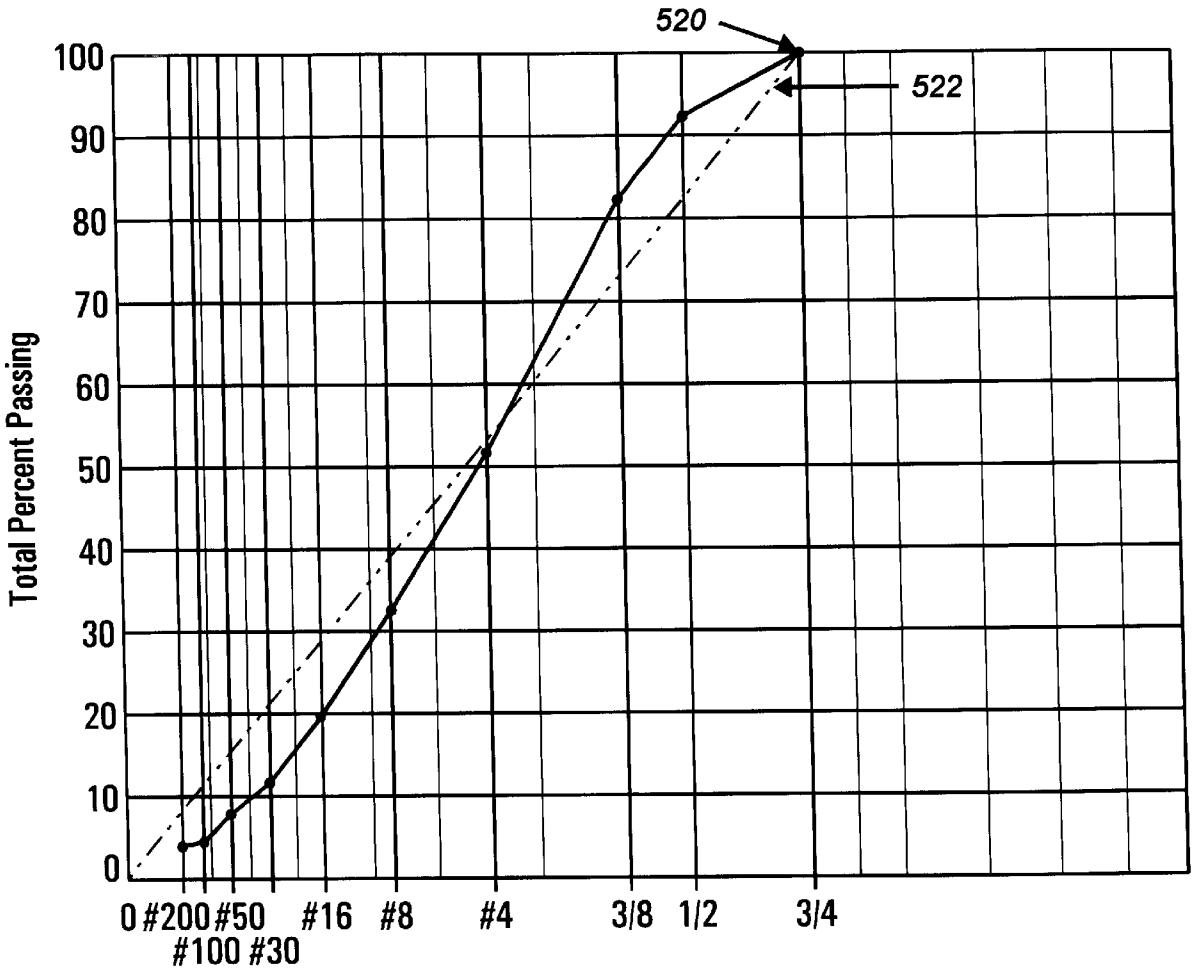
FIG. 15 is a chart illustrating the selected JMF plotted for a 0.45 maximum density gradation curve.
Figure 16:
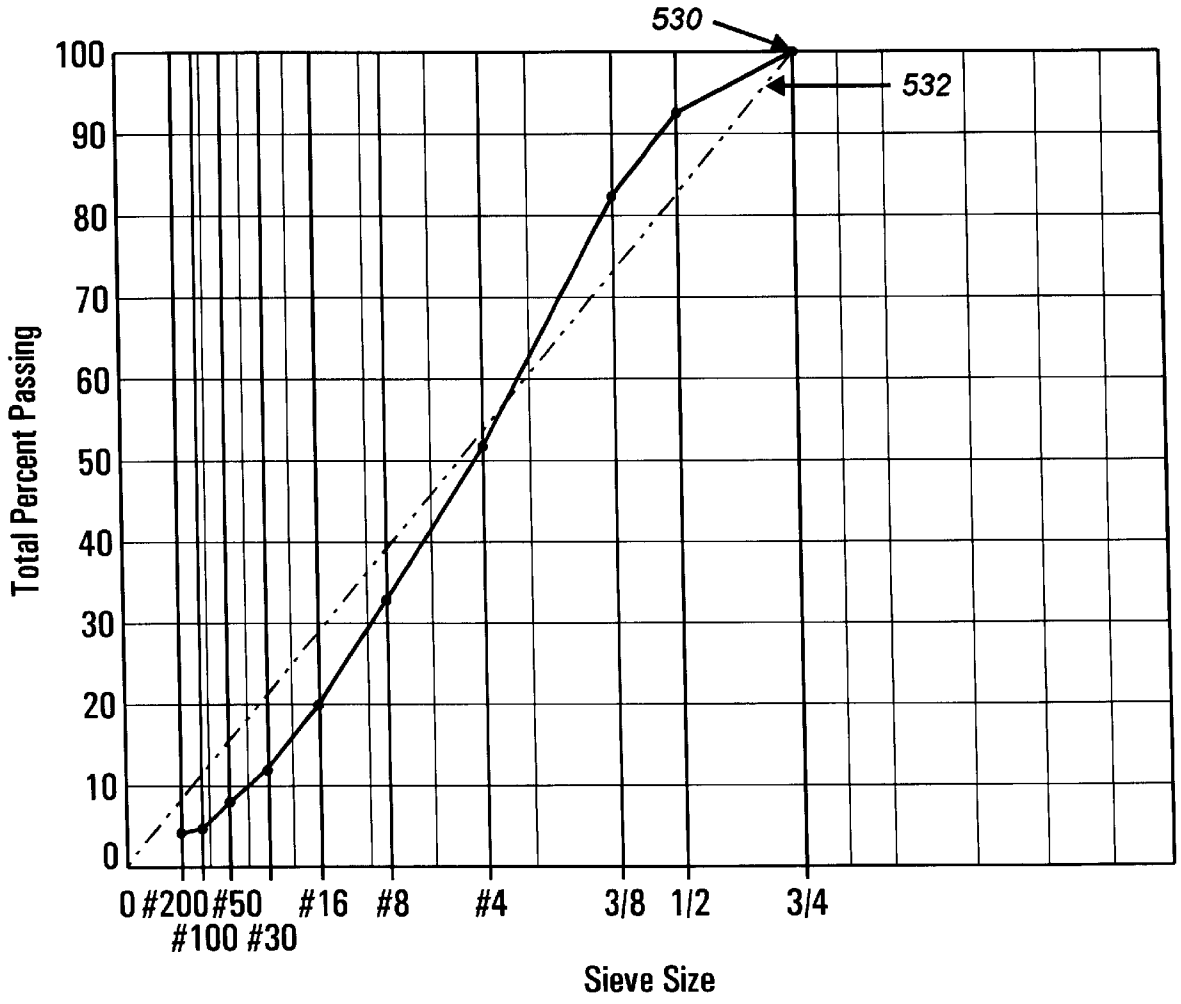
FIG. 16 is a chart illustrating the optimized 0.45 gradation curve in accordance with the steps of FIG. 15.

FIGS. 15 and 16 illustrate the corresponding charts when a maximum density line, for example a 0.45 gradation curve, is utilized in place of the semi-log gradation curve. In FIGS. 15 and 16, the gradation curves are plotted with X and Y coordinates, for which the X coordinate represents the sieve size, plotted in a 0.45 power scale while the Y coordinates represents the total percent by weight passing for a given sieve size on a linear scale. In these Figures, the area under the actual gradation from the maximum density provides the estimated VMA value. In FIGS. 15 and 16, dotted lines 522 and 532 are generated as the result of the data entered by the user in FIG. 3A. Additionally, darkened lines 520 of FIG. 15 and 530 of FIG. 16 illustrate the actual gradation curve. Further, the darkened line 530 of FIG. 16 shows the results of an optimized JMF for a maximum density plot. The JMFs illustrated thus satisfies the master limits and least cost constraints.

Figure 17:
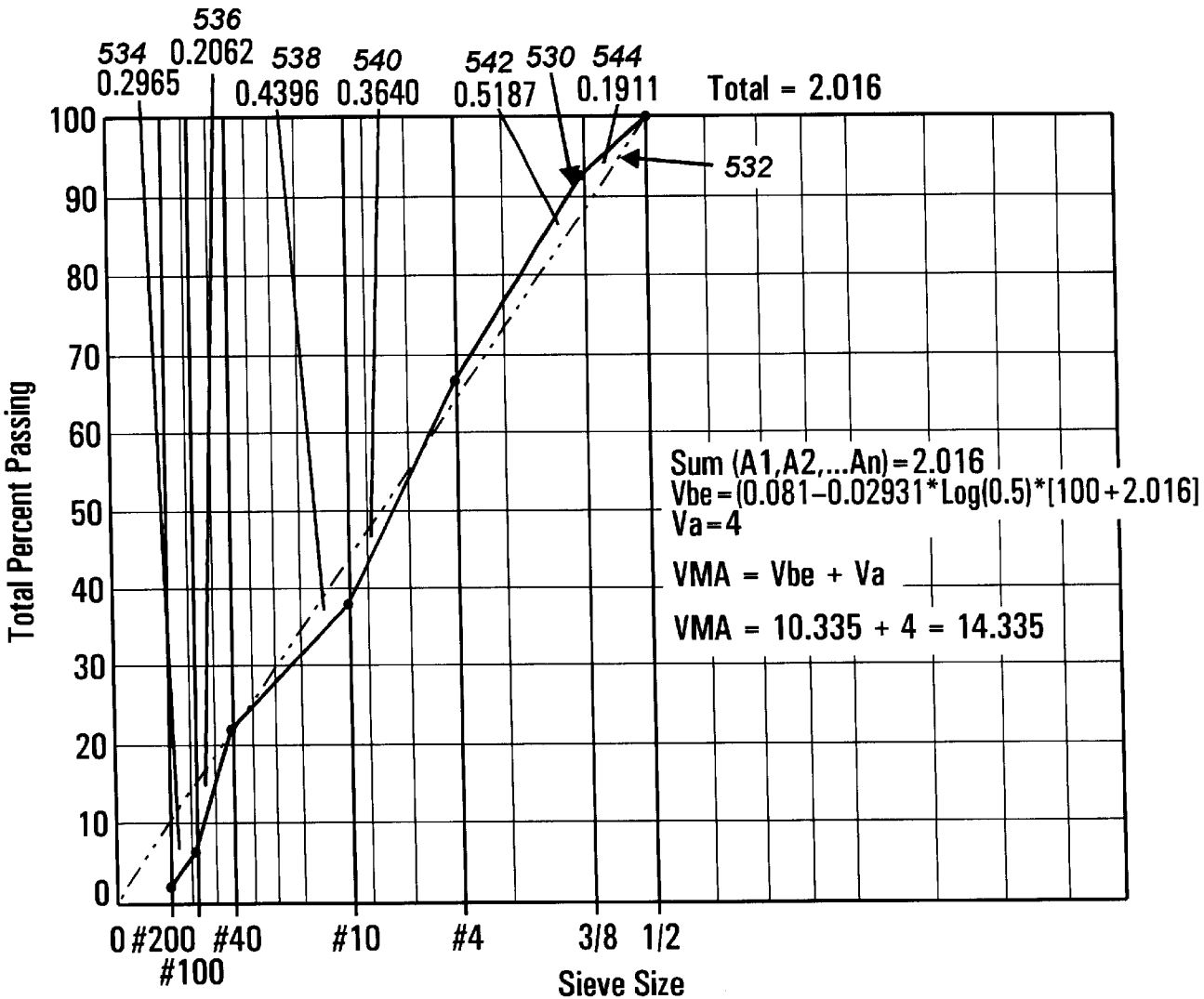
FIG. 17 is a chart illustrating the preferred process for generating the VMA value used by the apparatus and method of the present invention.

FIG. 17 is a chart illustrating the preferred process for generating the VMA value. As shown therein, the VMA generation process takes the area between a JMF curve 530 and a maximum density line or a 0.45 gradation curve 532. Between the curves 530 and 532, a plurality of regions 534, 536, 538, 540, 542 and 544 exist, each with a quantifiable region. As shown in FIG. 17, the respective area for the regions 534, 536, 538, 540, 542 and 544 are 0.2965, 0.2062, 0.4396, 0.3640, 0.5187, and 0.1911. The sum of the areas for these regions adds up to 2.016. From the summed value, the VMA determination process of FIG. 7 computes:

$$VMA_{est}=V_A+V_{BE}$$

where $V_A$, in %, is the proportion by total volume of air contained in the total mix, and $V_{BE}$, in %, is the proportion by total volume of the effective asphalt binder.

In sum, the present invention provides an apparatus which optimizes the job mix formulation for hot mix asphaltic concrete mixtures. The apparatus receives JMF data input, including hand-entered data, hand-drawn data, or computer optimized data. The apparatus then generates a voids in the mineral aggregate value. Next, it prompts the user to select a design methodology, including a Marshall mix methodology, a Hveem mix methodology, a Strategic Highway Research Program mix methodology, or a user definable mix methodology. Once the appropriate solution or methodology has been selected, the apparatus applies a number of computations which use the VMA value. The apparatus also generates an aggregate composition for the hot mix asphaltic composition satisfying the job mix formulation based on the JMF data input and the selected design methodology. All the mixture properties, including volumetric and mechanical properties are predicted. Essentially an entire mixture design can be modeled by only knowing basic material properties.

Thus, the present invention allows users to estimate final mixture design properties to minimize or avoid costly and time consuming laboratory studies. From the gradation chart input, the present invention estimates all design criteria, including volumetric properties such as bulk specific gravity of molded specimen ($G_{mb}$), voids in mineral aggregates (VMA), total voids in mixtures (VTM), voids filled with asphalt (VFA), densification curves and mechanical properties which are used in the design methodologies to arrive at blends of various aggregates of mixes matching the customer's design criteria and needs. The proposed design can also be verified for conformance to various volumetric properties and optimum binder contents by actual laboratory analysis. The verified mixture can then be further characterized by additional tests such as performance tests. Hence, the apparatus and method of the present invention avoids the inefficiency of the laboratory trial-and-error process by providing a quicker and easier to use system to determine the most cost effective blend of known aggregates into a satisfactory JMF specification.

The foregoing disclosure and description of the invention are illustrative and explanatory thereof, and various changes in the details of the illustrated apparatus and construction and method of operation may be made without departing from the spirit of the invention.

What is claimed is:

1. A method for optimizing a job mix formulation (JMF) satisfying a plurality of criteria, comprising:

receiving one or more basic material properties;

selecting a design methodology; and without requiring laboratory testing data, predicting a mixture of aggregate composition based on said basic material properties, said plurality of criteria and said design methodology.

2. The method of claim 1, wherein said design methodology applies a voids in mineral aggregates determination.

3. The method of claim 2, wherein said voids in mineral aggregates is determined as a function of an area between a curve satisfying said JMF and a maximum density line.

4. The method of claim 3, wherein said area is computed as:

$$\frac{1}{2}*\sum_{i=1}^{n}(D_{i+1}^{0.45}-D_i^{0.45})*(|JMF_{i+1}-M_{i+1}|+|JMF_i-M_i|)]$$

where $D_i$ is an $i^{th}$ sieve size, $JMF_i$ is a total percentage passing at the $i^{th}$ sieve size on said maximum density line, and $M_i$ is a total percentage passing at the $i^{th}$ sieve size as measured on a maximum density line.

5. The method of claim 2, wherein said voids in mineral aggregates determining step further comprises:

selecting a JMF data;

receiving a sieve analysis on said JMF data;

generating a total volume of an effective binder;

determining a total volume of voids in the mineral aggregate; and determining a value reflecting voids filled with aggregate.

6. The method of claim 1, further comprising the step of accepting hand-entered JMF data, hand-drawn JMF data, or computer optimized JMF data.

7. The method of claim 6, wherein said accepting step for receiving hand-drawn data comprises:

prompting a user to draw a JMF curve;

minimizing the curvature of said JMF curve; and generating a mixture of individual aggregates satisfying said JMF curve.

8. The method of claim 7, wherein said generating step applies an over-determine method.

9. The method of claim 6, wherein said receiving step further comprises:

defining one or more optimization parameters; and applying said optimization parameters to an optimizer.

10. The method of claim 9, wherein said optimization parameter defining step further comprises the step of selecting an optimization choice based on cost, master gradation limit, property, or user-defined criteria.

11. The method of claim 9, wherein said applying step further comprises:

selecting a master gradation limit;

selecting a least cost; and optimizing said gradation curve within said gradation limits based on said least cost, said basic material properties, or test results.

12. The method of claim 11, wherein said optimizing step applies a simplex optimization.

13. The method of claim 1, wherein said selecting step further comprises the step of selecting a Marshall mix methodology, a Hveem mix methodology, a Strategic Highway Research Program mix methodology, a user definable mix methodology, or a combination thereof.

14. The method of claim 13, wherein said Marshall mix comprises:

determining a volumetric property, including a value for total voids in the mixture, a voids in the mineral aggregate value, and a voids filled with asphalt value;

determining a bulk specific gravity value for each asphalt content;

determining a maximum specific gravity for each asphalt content;

determining a percentage of the total volume of mix of air voids for each asphalt content;

determining a Marshall stability value for each asphalt content; and determining a Marshall flow value for each asphalt content.

15. The method of claim 13, wherein said Hveem mix comprises:

performing a sieve analysis to determine the gradation of aggregates in the mixture;

determining a percentage of void in the mineral aggregate;

determining a specific gravity for each asphalt content;

determining a bulk unit weight for each asphalt content;

determining a maximum specific gravity for each asphalt content;

determining a percentage of the total volume of mix of air voids for each asphalt content; and determining a Hveem stability value for each asphalt content.

16. The method of claim 13, wherein said SHRP mix comprises:

performing a sieve analysis to determine the gradation of aggregates in the mixture;

determining a specific gravity for fine, intermediate and coarse gradations for each asphalt content;

determining a percent volume of asphalt binder;

determining an effective volume of the asphalt binder;

determining a bulk specific gravity of each asphalt content;

generating a correction factor and correcting said bulk specific gravity;

determining a percent correct maximum specific gravity for each asphalt content; and determining a percentage of the total volume of mix of air voids for each asphalt content.

17. The method of claim 1, wherein said selecting step further comprises the step of estimating bulk specific gravity, comprising:

performing a sieve analysis to determine the gradation of aggregates in the mixture;

generating a bulk specific gravity for the molded sample;

determining a maximum specific gravity for the mixture; and determining said bulk specific gravity for the mixture.

18. A method for optimizing a job mix formulation (JMF) for hot mix asphaltic concrete, comprising:

receiving a sieve analysis data on said JMF and on said JMF data input, including hand-entered data, hand-drawn data, or computer optimized data;

generating a voids in the mineral aggregate (VMA) value according to:

$$\frac{1}{2} * \sum_{i=1}^{n} (D_{i+1}^{0.45} - D_i^{0.45}) * (|JMF_{i+1} - M_{i+1}| + |JMF_i - M_i|)]$$

where $D_i$ is an $i^{th}$ sieve size, $JMF_i$ is a total percentage passing at the $i^{th}$ sieve size on said maximum density line, and $M_i$ is a total percentage passing at the $i^{th}$ sieve size as measured on a maximum density line;

applying said VMA value to a design methodology, including a Marshall mix methodology, a Hveem mix methodology, a Strategic Highway Research Program mix methodology, a user definable mix methodology, or a combination thereof; and predicting a mixture of aggregate composition based on said basic material properties, said plurality of criteria and said design methodology.

19. The method of claim 1, wherein said plurality of criteria include voids in total mixture, voids in the mineral aggregate, voids filled with aggregates, bulk unit weight, bulk specific gravity of the mixture specimens, densification curves, Marshall stability, Marshall flow, and Hveem stability.

20. The method of claim 1, wherein said receiving step further comprises the step of estimating volumetric property and test property from said basic properties.

21. A method for optimizing a job mix formulation (JMF) satisfying a plurality of criteria, comprising:

receiving one or more basic material properties;

determining an area between a curve satisfying said JMF and a maximum density line:

$$\frac{1}{2} * \sum_{i=1}^{n} (D_{i+1}^{0.45} - D_i^{0.45}) * (|JMF_{i+1} - M_{i+1}| + |JMF_i - M_i|)]$$

where $D_i$ is an $i^{th}$ sieve size, $JMF_i$ is a total percentage passing at the $i^{th}$ sieve size on said maximum density line, and $M_i$ is a total percentage passing at the $i^{th}$ sieve size as measured on a maximum density line; and predicting a mixture of aggregate composition based on said basic material properties, said plurality of criteria and said area.

22. A program storage device having a computer readable code embodied therein for optimizing a job mix formulation (JMF) satisfying a plurality of criteria, said program storage device comprising:

a code for receiving one or more basic material properties;

a code for determining an area between a curve satisfying said JMF and a maximum density line as follows:

$$\frac{1}{2} * \sum_{i=1}^{n} (D_{i+1}^{0.45} - D_i^{0.45}) * (|JMF_{i+1} - M_{i+1}| + |JMF_i - M_i|)]$$

where $D_i$ is an $i^{th}$ sieve size, $JMF_i$ is a total percentage passing at the $i^{th}$ sieve size on said maximum density line, and $M_i$ is a total percentage passing at the $i^{th}$ sieve size as measured on a maximum density line; and a code for predicting a mixture of aggregate composition based on said basic material properties, said plurality of criteria and said area.

23. A program storage device having a computer readable code embodied therein for optimizing a job mix formulation (JMF) satisfying a plurality of criteria, said program storage device comprising:

a code for receiving one or more basic material properties;

a code for selecting a design methodology; and a code for predicting without requiring laboratory testing data a mixture of aggregate composition based on said basic material properties, said plurality of criteria and said design methodology.

24. The program storage device of claim 23, wherein said design methodology code further comprises a code for determining a voids in mineral aggregates value.

25. The program storage device of claim 24, wherein said code for determining voids in mineral aggregates generates an area between a curve satisfying said JMF and a maximum density line.

26. The program storage device of claim 25, wherein said area is computed as:

$$\frac{1}{2} * \sum_{i=1}^{n} (D_{i+1}^{0.45} - D_i^{0.45}) * (|JMF_{i+1} - M_{i+1}| + |JMF_i - M_i|)]$$

where $D_i$ is an $i^{th}$ sieve size, $JMF_i$ is a total percentage passing at the $i^{th}$ sieve size on said maximum density line, and $M_i$ is a total percentage passing at the $i^{th}$ sieve size as measured on a maximum density line.

27. The program storage device of claim 23, further comprising a code for estimating volumetric property and test property from said basic properties.

28. The program storage device of claim 23, further comprising a code for estimating voids in the mineral aggregates, bulk specific gravity of a molded laboratory specimen, specimen height during a compaction process, densification curves and mechanical properties.

29. The program storage device of claim 23, further comprising a code for accepting hand-entered JMF data, hand-drawn JMF data, or computer optimized JMF data.

30. The program storage device of claim 23, wherein said receiving code further comprises:

a code for defining one or more optimization parameters; and a code for applying said optimization parameters to an optimizer.

31. The program storage device of claim 23, wherein said selecting code further comprises a code for selecting a Marshall mix methodology, a Hveem mix methodology, a Strategic Highway Research Program mix methodology, a user definable mix methodology, or a combination thereof.

32. A computer system, comprising:

a data input device;

a display device;

a processor coupled to said data input device and said display device; and a program storage device coupled to said processor, said program storage device having a computer readable code embodied therein for optimizing a job mix formulation (JMF) satisfying a plurality of criteria, said program storage device having:

a code for receiving one or more basic material properties;

a code for selecting a design methodology; and a code for predicting a mixture of aggregate composition based on said basic material properties, said plurality of criteria and said design methodology.

33. The computer system of claim 32, wherein said design methodology code further comprises a code for determining a voids in mineral aggregates value.

34. The computer system of claim 33, wherein said code for determining voids in mineral aggregates generates an area between a curve satisfying said JMF and a maximum density line.

35. The computer system of claim 34, wherein said area is computed as:

$$\frac{1}{2} * \sum_{i=1}^{n} (D_{i+1}^{0.45} - D_i^{0.45}) * (|JMF_{i+1} - M_{i+1}| + |JMF_i - M_i|)]$$

where $D_i$ is an $i^{th}$ sieve size, $JMF_i$ is a total percentage passing at the $i^{th}$ sieve size on said maximum density line, and $M_i$ is a total percentage passing at the $i^{th}$ sieve size as measured on a maximum density line.

36. The computer system of claim 32, further comprising a code for estimating volumetric property and test property from said basic properties.

37. The computer system of claim 32, further comprising a code for estimating voids in the mineral aggregates, bulk specific gravity of a molded laboratory specimen, and specimen height during a compaction process.

38. The computer system of claim 32, further comprising a code for accepting hand-entered JMF data, hand-drawn JMF data, or computer optimized JMF data.

39. The computer system of claim 32, wherein said receiving code further comprises:

a code for defining one or more optimization parameters; and a code for applying said optimization parameters to an optimizer.

40. The computer system of claim 32, wherein said selecting code further comprises a code for selecting a Marshall mix methodology, a Hveem mix methodology, a Strategic Highway Research Program mix methodology, a user definable mix methodology, or a combination thereof.

* * * * *